US009951566B1

(12) United States Patent
Bertagnolli et al.

(10) Patent No.: US 9,951,566 B1
(45) **Date of Patent: *Apr. 24, 2018**

(54) SUPERABRASIVE ELEMENTS, METHODS OF MANUFACTURING, AND DRILL BITS INCLUDING SAME

(71) Applicant: US SYNTHETIC CORPORATION, Orem, UT (US)

(72) Inventors: Kenneth E. Bertagnolli, Riverton, UT (US); David P. Miess, Highland, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/067,831

(22) Filed: Oct. 30, 2013

Related U.S. Application Data

(60) Continuation of application No. 12/548,584, filed on Aug. 27, 2009, now Pat. No. 8,778,040, which is a (Continued)

(51) Int. Cl.
*B24D 3/00* (2006.01)
*B24D 11/00* (2006.01)

(Continued)

(52) U.S. Cl.
CPC ..... *E21B 10/567* (2013.01); *B24D 3/007* (2013.01); *B24D 18/0009* (2013.01); *E21B 10/55* (2013.01); *E21B 10/5735* (2013.01)

(58) Field of Classification Search
None
See application file for complete search history.

(56) References Cited

U.S. PATENT DOCUMENTS 2,349,577 A 5/1944 Dean
3,745,623 A 7/1973 Wentorf, Jr. et al.

(Continued)

FOREIGN PATENT DOCUMENTS

EP 0 297 071 12/1988
EP 0 352 811 1/1990

(Continued)

OTHER PUBLICATIONS

Clegg, J. "Faster, Longer, and More-Reliable Bit Runs With New-Generation PDC Cutter" Society of Petroleum Engineers Annual Technical Conference and Exhibition, San Antonio, Texas, U.S.A. (Sep. 24-27, 2006).*

(Continued)

*Primary Examiner* — Jennifer A Smith
*Assistant Examiner* — Ross J. Christie
(74) *Attorney, Agent, or Firm* — Dorsey & Whitney LLP

(57) ABSTRACT

Methods of manufacturing a superabrasive element are disclosed. In one embodiment, a substrate and a preformed superabrasive volume may be at least partially surrounded by an enclosure and the enclosure may be sealed in an inert environment. Further, the enclosure may be exposed to an elevated pressure and preformed superabrasive volume may be affixed to the substrate. Polycrystalline diamond elements are disclosed. In one embodiment, a polycrystalline diamond element may comprise a preformed polycrystalline diamond volume bonded to a substrate by a braze material. Optionally, such a polycrystalline diamond element may exhibit a compressive stress. Rotary drill bit for drilling a subterranean formation and including at least one superabrasive element are also disclosed.

18 Claims, 11 Drawing Sheets

Related U.S. Application Data division of application No. 11/545,929, filed on Oct. 10, 2006, now Pat. No. 8,236,074.

(51) Int. Cl.

| | |
|---|---|
| ***B24D 18/00*** | (2006.01) |
| ***E21B 10/567*** | (2006.01) |
| ***E21B 10/55*** | (2006.01) |
| ***E21B 10/573*** | (2006.01) |

(56) References Cited

U.S. PATENT DOCUMENTS

| | | | | |
|---|---|---|---|---|
| 3,786,552 | A | | 1/1974 | Saito et al. |
| 3,918,219 | A | | 11/1975 | Wentorf, Jr. et al. |
| 4,009,027 | A | | 2/1977 | Naidich et al. |
| 4,016,736 | A | | 4/1977 | Carrison et al. |
| 4,063,909 | A | | 12/1977 | Mitchell |
| 4,084,942 | A | | 4/1978 | Villalobos |
| 4,191,735 | A | | 3/1980 | Nelson et al. |
| 4,224,380 | A | | 9/1980 | Bovenkerk et al. |
| 4,268,276 | A | | 5/1981 | Bovenkerk |
| 4,274,900 | A | | 6/1981 | Mueller et al. |
| 4,288,248 | A | | 9/1981 | Bovenkerk et al. |
| 4,333,902 | A | | 6/1982 | Hara |
| 4,410,054 | A | | 10/1983 | Nagal et al. |
| 4,440,573 | A | | 4/1984 | Ishizuka |
| 4,460,382 | A | | 7/1984 | Ohno |
| 4,468,138 | A | | 8/1984 | Nagel |
| 4,525,179 | A | | 6/1985 | Gigl |
| 4,560,014 | A | | 12/1985 | Geczy |
| 4,676,124 | A | | 6/1987 | Fischer |
| 4,692,418 | A | | 9/1987 | Boecker et al. |
| 4,738,322 | A | | 4/1988 | Hall et al. |
| 4,766,027 | A | | 8/1988 | Burn et al. |
| 4,778,486 | A | | 10/1988 | Csillag et al. |
| 4,783,245 | A | | 11/1988 | Nakamura et al. |
| 4,797,326 | A | | 1/1989 | Csillag |
| 4,811,801 | A | | 3/1989 | Salesky et al. |
| 4,871,377 | A | | 10/1989 | Frushour |
| 4,913,247 | A | | 4/1990 | Jones |
| 4,940,180 | A | | 7/1990 | Martell |
| 4,944,772 | A | | 7/1990 | Cho |
| 4,985,051 | A | | 1/1991 | Ringwood |
| 4,992,082 | A | | 2/1991 | Drawl et al. |
| 5,000,273 | A | | 3/1991 | Horton et al. |
| 5,011,514 | A | | 4/1991 | Cho et al. |
| 5,016,718 | A | | 5/1991 | Tandberg |
| 5,032,147 | A | | 7/1991 | Frushour |
| 5,049,164 | A | | 9/1991 | Horton et al. |
| 5,057,124 | A | * | 10/1991 | Cerceau ..... B22F 7/06 51/293 |
| 5,092,687 | A | | 3/1992 | Hall |
| 5,116,568 | A | | 5/1992 | Sung et al. |
| 5,120,327 | A | | 6/1992 | Dennis |
| 5,127,923 | A | | 7/1992 | Bunting et al. |
| 5,135,061 | A | | 8/1992 | Newton, Jr. |
| 5,151,107 | A | | 9/1992 | Cho et al. |
| 5,154,245 | A | | 10/1992 | Walderstrom et al. |
| 5,173,091 | A | | 12/1992 | Marek |
| 5,180,022 | A | | 1/1993 | Brady |
| 5,217,154 | A | | 6/1993 | Elwood et al. |
| 5,304,342 | A | | 4/1994 | Hall, Jr. et al. |
| 5,326,380 | A | | 7/1994 | Yao et al. |
| 5,348,109 | A | | 9/1994 | Griffin et al. |
| 5,355,969 | A | | 10/1994 | Hardy et al. |
| 5,364,192 | A | | 11/1994 | Damm et al. |
| 5,368,398 | A | | 11/1994 | Damm et al. |
| 5,370,195 | A | | 12/1994 | Keshavan et al. |
| 5,460,233 | A | | 10/1995 | Meany et al. |
| 5,480,233 | A | | 1/1996 | Cunningham |
| 5,544,713 | A | | 8/1996 | Dennis |
| 5,617,997 | A | | 4/1997 | Kobayashi et al. |
| 5,645,617 | A | | 7/1997 | Frushour |
| 5,660,075 | A | | 8/1997 | Johnson et al. |
| 5,722,499 | A | | 3/1998 | Nguyen et al. |
| 5,740,874 | A | | 4/1998 | Matthias |
| 5,819,862 | A | * | 10/1998 | Matthias ..... E21B 17/1092 175/428 |
| 5,876,859 | A | | 3/1999 | Saxelby, Jr. et al. |
| 5,954,147 | A | * | 9/1999 | Overstreet ..... E21B 10/567 175/374 |
| 5,976,707 | A | | 11/1999 | Grab |
| 6,054,693 | A | | 4/2000 | Barmatz et al. |
| 6,165,616 | A | | 12/2000 | Lemelson et al. |
| 6,196,340 | B1 | | 3/2001 | Jensen et al. |
| 6,202,770 | B1 | * | 3/2001 | Jurewicz ..... E21B 10/5673 175/428 |
| 6,202,772 | B1 | | 3/2001 | Eyre et al. |
| 6,209,429 | B1 | | 4/2001 | Urso, III et al. |
| 6,220,375 | B1 | | 4/2001 | Butcher et al. |
| 6,258,139 | B1 | | 7/2001 | Jensen |
| 6,270,548 | B1 | | 8/2001 | Campbell et al. |
| 6,272,753 | B2 | | 8/2001 | Packer |
| 6,302,225 | B1 | | 10/2001 | Yoshida et al. |
| 6,338,754 | B1 | | 1/2002 | Cannon et al. |
| 6,344,149 | B1 | | 2/2002 | Oles |
| 6,390,181 | B1 | | 5/2002 | Hall et al. |
| 6,405,814 | B1 | | 6/2002 | Eyre et al. |
| 6,410,085 | B1 | | 6/2002 | Griffin et al. |
| 6,435,058 | B1 | | 8/2002 | Matthias et al. |
| 6,481,511 | B2 | | 11/2002 | Matthias et al. |
| 6,544,308 | B2 | | 4/2003 | Griffin et al. |
| 6,562,462 | B2 | | 5/2003 | Griffin et al. |
| 6,585,064 | B2 | | 7/2003 | Griffin et al. |
| 6,589,640 | B2 | | 7/2003 | Griffin et al. |
| 6,592,985 | B2 | | 7/2003 | Griffin et al. |
| 6,601,662 | B2 | | 8/2003 | Matthias et al. |
| 6,739,214 | B2 | | 5/2004 | Griffin et al. |
| 6,749,033 | B2 | | 6/2004 | Griffin et al. |
| 6,793,681 | B1 | | 9/2004 | Pope et al. |
| 6,797,326 | B2 | | 9/2004 | Griffin et al. |
| 6,861,098 | B2 | | 3/2005 | Griffin et al. |
| 6,861,137 | B2 | | 3/2005 | Griffin et al. |
| 6,878,447 | B2 | | 4/2005 | Griffin et al. |
| 6,892,836 | B1 | | 5/2005 | Eyre et al. |
| 6,991,049 | B2 | | 1/2006 | Eyre et al. |
| 7,060,641 | B2 | | 6/2006 | Qian et al. |
| 7,377,341 | B2 | | 5/2008 | Middlemiss et al. |
| 7,384,821 | B2 | | 6/2008 | Sung |
| 7,473,287 | B2 | | 1/2009 | Belnap et al. |
| 7,516,804 | B2 | | 4/2009 | Vail |
| 7,552,782 | B1 | | 6/2009 | Sexton et al. |
| 7,559,695 | B2 | | 7/2009 | Sexton et al. |
| 7,559,965 | B2 | | 7/2009 | Oh |
| 7,569,176 | B2 | | 8/2009 | Pope et al. |
| 7,608,333 | B2 | | 10/2009 | Eyre et al. |
| 7,635,035 | B1 | | 12/2009 | Bertagnolli et al. |
| 7,647,933 | B2 | | 1/2010 | Middlemiss |
| 7,694,757 | B2 | | 4/2010 | Keshavan et al. |
| 7,726,421 | B2 | | 6/2010 | Middlemiss |
| 7,740,673 | B2 | | 6/2010 | Eyre et al. |
| 7,753,143 | B1 | | 7/2010 | Miess et al. |
| 7,754,333 | B2 | | 7/2010 | Eyre et al. |
| 7,828,088 | B2 | | 11/2010 | Middlemiss et al. |
| 7,841,428 | B2 | | 11/2010 | Bertagnolli |
| 7,845,438 | B1 | | 12/2010 | Vail et al. |
| 7,866,418 | B2 | | 1/2011 | Bertagnolli et al. |
| 7,942,219 | B2 | | 3/2011 | Keshavan et al. |
| 7,980,334 | B2 | | 7/2011 | Voronin et al. |
| 8,002,859 | B2 | | 8/2011 | Griffo et al. |
| 8,028,771 | B2 | | 10/2011 | Keshavan et al. |
| 8,034,136 | B2 | | 10/2011 | Sani |
| 8,056,650 | B2 | | 11/2011 | Middlemiss |
| 8,066,087 | B2 | | 11/2011 | Griffo et al. |
| 8,069,937 | B2 | | 12/2011 | Mukhopadhyay |
| 8,071,173 | B1 | | 12/2011 | Sani |
| 8,080,071 | B1 | | 12/2011 | Vail et al. |
| 8,080,074 | B2 | | 12/2011 | Sani |
| 8,147,572 | B2 | | 4/2012 | Eyre et al. |
| 8,202,335 | B2 | | 6/2012 | Cooley et al. |
| 8,236,074 | B1 | | 8/2012 | Bertagnolli |
| 8,297,382 | B2 | | 10/2012 | Bertagnolli et al. |
| 8,323,367 | B1 | | 12/2012 | Bertagnolli |
| 8,328,891 | B2 | | 12/2012 | Zhang et al. |

(56) References Cited

U.S. PATENT DOCUMENTS 8,353,371 B2 1/2013 Cooley et al.
8,415,033 B2 4/2013 Matsuzawa et al.
8,529,649 B2 9/2013 Sani
8,616,306 B2 12/2013 Bertagnolli et al.
8,911,521 B1 12/2014 Miess et al.
8,979,956 B2 3/2015 Sani
2001/0004946 A1 6/2001 Jensen
2001/0040053 A1 11/2001 Beuershausen
2002/0029909 A1 3/2002 Griffo et al.
2002/0079140 A1 6/2002 Eyre et al.
2003/0019333 A1 1/2003 Scott
2003/0079918 A1 5/2003 Eyre et al.
2003/0191533 A1 10/2003 Dixon et al.
2004/0111159 A1 6/2004 Pope et al.
2004/0112650 A1 6/2004 Moseley
2004/0155096 A1 8/2004 Zimmerman et al.
2005/0044800 A1 3/2005 Hall et al.
2005/0050801 A1 3/2005 Cho et al.
2005/0117984 A1 6/2005 Eason
2005/0189443 A1 9/2005 Taylor et al.
2005/0210755 A1 9/2005 Cho et al.
2005/0211475 A1 9/2005 Mirchandani et al.
2005/0247492 A1* 11/2005 Shen ..... E21B 10/5735 175/426
2006/0042172 A1 3/2006 Sung
2006/0054363 A1 3/2006 Eyre et al.
2006/0060391 A1 3/2006 Eyre et al.
2006/0060392 A1 3/2006 Eyre
2006/0157884 A1 7/2006 Ludtke et al.
2006/0165993 A1* 7/2006 Keshavan ..... B24D 18/0009 51/293
2006/0180354 A1 8/2006 Belnap et al.
2006/0207802 A1 9/2006 Zhang et al.
2006/0254830 A1* 11/2006 Radtke ..... E21B 10/5735 175/426
2006/0263233 A1 11/2006 Gardinier
2006/0266558 A1 11/2006 Middlemiss et al.
2006/0266559 A1 11/2006 Keshavan et al.
2007/0023206 A1* 2/2007 Keshavan ..... E21B 10/16 175/374
2007/0034416 A1 2/2007 Cho et al.
2007/0056778 A1 3/2007 Webb et al.
2007/0079994 A1 4/2007 Middlemiss
2007/0102202 A1 5/2007 Choe et al.
2007/0187155 A1 8/2007 Middlemiss
2008/0019098 A1 1/2008 Sung
2008/0142276 A1* 6/2008 Griffo ..... E21B 10/5735 175/432
2008/0185189 A1* 8/2008 Griffo ..... B01J 3/062 175/433
2008/0206576 A1 8/2008 Qian et al.
2008/0223575 A1 9/2008 Oldham et al.
2008/0223621 A1 9/2008 Middlemiss et al.
2008/0223623 A1 9/2008 Keshavan et al.
2008/0230279 A1 9/2008 Bitler et al.
2008/0230280 A1 9/2008 Keshavan et al.
2008/0247899 A1 10/2008 Cho et al.
2009/0120009 A1 5/2009 Sung
2009/0152015 A1 6/2009 Sani et al.
2009/0166094 A1 7/2009 Keshavan et al.
2009/0173015 A1 7/2009 Keshavan et al.
2009/0173547 A1 7/2009 Voronin et al.
2009/0313908 A1 12/2009 Zhang et al.
2010/0012389 A1 1/2010 Zhang et al.
2010/0038148 A1 2/2010 King
2010/0095602 A1 4/2010 Belnap et al.
2010/0104874 A1 4/2010 Yong et al.
2010/0122852 A1 5/2010 Russell et al.
2010/0155149 A1 6/2010 Keshavan et al.
2010/0181117 A1 7/2010 Scott
2010/0186303 A1 7/2010 Ras et al.
2010/0196717 A1 8/2010 Liversage et al.
2010/0212971 A1 8/2010 Mukhopadhyay
2010/0236836 A1 9/2010 Voronin
2010/0243336 A1 9/2010 Dourfaye et al.
2010/0281782 A1 11/2010 Keshavan et al.
2010/0287845 A1 11/2010 Montross et al.
2010/0294571 A1 11/2010 Belnap et al.
2011/0023375 A1 2/2011 Sani et al.
2011/0031031 A1 2/2011 Vempati et al.
2011/0036643 A1 2/2011 Belnap et al.
2011/0042149 A1 2/2011 Scott et al.
2011/0056753 A1 3/2011 Middlemiss et al.
2011/0067929 A1 3/2011 Mukhopadhyay et al.
2011/0083908 A1 4/2011 Shen et al.
2011/0088950 A1 4/2011 Scott et al.
2011/0120782 A1 5/2011 Cooley et al.
2011/0259648 A1 10/2011 Sani
2011/0284294 A1 11/2011 Cox et al.
2012/0037429 A1 2/2012 Davies et al.
2012/0047815 A1 3/2012 Sani
2012/0080239 A1 4/2012 Lyons et al.
2012/0103701 A1 5/2012 Cho et al.
2012/0138370 A1 6/2012 Mukhopadhyay et al.
2012/0228037 A1* 9/2012 Cooley ..... B24D 3/10 175/428
2012/0241224 A1* 9/2012 Qian ..... B22F 5/00 51/297
2013/0205677 A1 8/2013 Bertagnolli et al.
2013/0291443 A1 11/2013 Naidoo et al.
2014/0223835 A1 8/2014 Thigpen et al.
2014/0283457 A1 9/2014 Cariveau et al.
2015/0114726 A1 4/2015 Shen et al.

FOREIGN PATENT DOCUMENTS

EP 0 374 424 6/1990
EP 0 699 642 3/1996
GB 2300424 11/1996
GB 2 461 198 12/2009
WO WO 08/063568 5/2008
WO WO 2009/125355 10/2009
WO WO 2010/039346 4/2010
WO WO 2010/098978 9/2010
WO WO 2010/100629 9/2010
WO WO 2010/100630 9/2010

OTHER PUBLICATIONS

U.S. Appl. No. 14/512,007, filed Oct. 10, 2014, Bertagnolli et al.
U.S. Appl. No. 13/171,735, Aug. 6, 2014, Issue Notification.
U.S. Appl. No. 14/327,264, filed Jul. 9, 2014, Sani.
U.S. Appl. No. 14/330,851, filed Jul. 14, 2014, Sani.
U.S. Appl. No. 14/495,759, filed Sep. 24, 2014, Sani.
U.S. Appl. No. 14/504,253, filed Oct. 1, 2014, Bertagnolli et al.
U.S. Appl. No. 12/548,584, Jun. 25, 2014, Issue Notification.
U.S. Appl. No. 13/032,350, Aug. 13, 2014, Issue Notification.
U.S. Appl. No. 13/100,388, Jun. 17, 2014, Notice of Allowance.
U.S. Appl. No. 13/100,388, Aug. 4, 2014, Notice of Allowance.
U.S. Appl. No. 13/285,198, Jul. 30, 2014, Issue Notification.
U.S. Appl. No. 13/292,491, Aug. 8, 2014, Office Action.
U.S. Appl. No. 13/027,954, Sep. 12, 2014, Notice of Allowance.
U.S. Appl. No. 13/690,397, Jul. 9, 2014, Issue Notification.
U.S. Appl. No. 13/917,952, Jun. 11, 2014, Issue Notification.
U.S. Appl. No. 13/323,138, Jul. 29, 2014, Notice of Allowance.
U.S. Appl. No. 13/397,971, Jun. 19, 2014, Office Action.
U.S. Appl. No. 13/953,453, Jun. 24, 2014, Notice of Allowance.
U.S. Appl. No. 14/178,118, Sep. 10, 2015, Office Action.
U.S. Appl. No. 14/297,359, filed Jun. 5, 2014, Miess et al.
U.S. Appl. No. 13/027,954, Jun. 3, 2014, Notice of Allowance.
U.S. Appl. No. 14/264,932, filed Apr. 29, 2014, Vail.
U.S. Appl. No. 13/032,350, Apr. 15, 2014, Notice of Allowance.
U.S. Appl. No. 13/171,735, May 7, 2014, Notice of Allowance.
U.S. Appl. No. 13/285,198, Apr. 11, 2014, Notice of Allowance.
U.S. Appl. No. 12/961,787, Apr. 11, 2014, Office Action.
U.S. Appl. No. 13/292,900, May 28, 2014, Issue Notification.
U.S. Appl. No. 13/285,198, Nov. 22, 2013, Notice of Allowance.
U.S. Appl. No. 13/292,491, Oct. 29, 2013, Advisory Action.
U.S. Appl. No. 13/027,954, Nov. 13, 2013, Office Action.

(56) References Cited

OTHER PUBLICATIONS

U.S. Appl. No. 13/690,397, Nov. 25, 2013, Office Action.
U.S. Appl. No. 13/917,952, Nov. 25, 2013, Office Action.
U.S. Appl. No. 13/292,900, Nov. 25, 2013, Notice of Allowance.
U.S. Appl. No. 13/323,138, Nov. 29, 2013, Notice of Allowance.
U.S. Appl. No. 60/850,969, filed Oct. 10, 2006, Cooley, et al.
U.S. Appl. No. 60/860,098, filed Nov. 20, 2006, Sani.
U.S. Appl. No. 60/876,701, filed Dec. 21, 2006, Sani.
U.S. Appl. No. 61/068,120, filed Mar. 3, 2008, Vail.
U.S. Appl. No. 12/548,584, filed Aug. 27, 2009, Bertagnolli.
U.S. Appl. No. 13/027,954, filed Feb. 15, 2011, Miess et al.
U.S. Appl. No. 13/100,388, filed May 4, 2011, Jones et al.
U.S. Appl. No. 13/171,735, filed Jun. 29, 2011, Bertagnolli.
U.S. Appl. No. 13/285,198, filed Oct. 31, 2011, Sani.
U.S. Appl. No. 13/292,900, filed Nov. 9, 2011, Vail.
U.S. Appl. No. 13/323,138, filed Dec. 12, 2011, Miess et al.
U.S. Appl. No. 13/690,397, filed Nov. 30, 2012, Miess et al.
U.S. Appl. No. 13/397,971, filed Feb. 16, 2012, Miess et al.
U.S. Appl. No. 13/953,453, filed Jul. 29, 2013, Sani.
Akaishi, Minoru, "Synthesis of polycrystalline diamond compact with magnesium carbonate and its physical properties," Diamond and Related Materials, 1996 (pp. 2-7).
Declaration of Prior Sales of Terracut PDCS executed by Kenneth E. Bertagnolli Feb. 3, 2011.
Declaration of Prior Sales of Terracut PDCS executed by Paul D. Jones Feb. 3, 2011.
Ekimov, E.A., et al. "Mechanical Properties and Microstructure of Diamond-SiC Nanocomposites" Inorganic Materials, vol. 38, No. 11, 2002, pp. 1117-1122.
Glowka, D.A. & Stone, C.M., "Effects of Termal and Mechanical Loading on PDC Bit Life", SPE Drilling Engineering, Jun. 1986 (pp. 201-214).
Hosomi, Satoru, et al., "Diamond Formation by a Solid State Reaction", Science and Technology of New Diamond, pp. 239-243 (1990).
Hsueh, C.H. & Evans, A.G., "Residual Stresses in Metal/Ceramic Bonded Strips", J. Am. Ceram. Soc., 68 [5] (1985) pp. 241-248.
International Search Report and Written Opinion for PCT International Application No. PCT/US2007/024090; Apr. 15, 2008.
International Search Report and Written Opinion from International Application No. PCT/US2011/060380 dated Mar. 12, 2012.
Ledbetter, H.M., et al. "Elastic Properties of Metals and Alloys. II. Copper", Journal of Physics and Chemical Reference Data, vol. 3, No. 4, 1974. pp. 897-935.
Lin, Tze-Pin; Hood, Michael & Cooper George A., "Residual Stresses in Polycrystalline Diamond Compacts", J. Am. Ceram Soc., 77 [6] (1994) pp. 1562-1568.
Liu, Xueran, et al., "Fabrication of the supersaturated solid solution of carbon in copper by mechanical alloying", Materials Characterization, vol. 58, Issue 8 (Jun. 2007), pp. 504-508.
Orwa, J.O., et al., "Diamond nanocrystals formed by direct implantation of fused silica with carbon," Journal of Applied Physics, vol. 90, No. 6, 2001, pp. 3007-3018.
Radtke, Robert, "Faster Drilling, Longer Life: Thermally Stable Diamond Drill Bit Cutters," Drilling Systems, Summer 2004 (pp. 5-9).
Saji, S., et al., Solid Solubility of Carbon in Copper during Mechanical Alloying, Materials Transactions, vol. 39, No. 7 (1998), pp. 778-781.
Suryanarayana, C., "Novel Methods of BRAZING Dissimilar Materials," Advanced Materials & Processes, Mar. 2001 (3 pgs).
Tanaka, T., et al., "Formation of Metastable Phases of Ni—C and Co—C Systems by Mechanical Alloying", Metallurgical Transactions, vol. 23A, Sep. 1992, pp. 2431-2435.
Timoshenko, S.P. & Goodler, J.N., "Theory of Elasticity", McGraw-Hill Classic Textbook Reissue 1934, pp. 8-11, 456-458.
Tomlinson, P.N. et al. "Syndax3 Pins—New Concepts in PCD Drilling," Rock Drilling, IDR 3/92, 1992 (pp. 109-114).
Ueda, Fumihiro, "Cutting performance of sintered diamond with MgCO3 as a sintering agent," Materials Science and Engineering, 1996 (pp. 260-263).
Yamane, T., et al., "Solid solubility of carbon in copper mechanically alloyed", Journal of Materials Science Letters 20 (2001), pp. 259-260.
U.S. Appl. No. 11/983,619, May 26, 2010, Office Action.
U.S. Appl. No. 11/545,929, Aug. 13, 2008, Office Action.
U.S. Appl. No. 11/545,929, Jan. 21, 2009, Office Action.
U.S. Appl. No. 11/545,929, Aug. 27, 2009, Office Action.
U.S. Appl. No. 11/545,929, Apr. 15, 2010, Office Action.
U.S. Appl. No. 11/545,929, Jul. 21, 2010, Office Action.
U.S. Appl. No. 11/545,929, Mar. 20, 2012, Notice of Allowance.
U.S. Appl. No. 11/545,929, Jul. 18, 2012, Issue Notification.
U.S. Appl. No. 11/983,619, Aug. 9, 2010, Office Action.
U.S. Appl. No. 11/983,619, Mar. 28, 2011, Office Action.
U.S. Appl. No. 11/983,619, Jun. 16, 2011, Notice of Allowance.
U.S. Appl. No. 11/983,619, Sep. 21, 2011, Issue Notification.
U.S. Appl. No. 12/271,081, Dec. 22, 2010, Office Action.
U.S. Appl. No. 12/271,081, Mar. 31, 2011, Office Action.
U.S. Appl. No. 12/271,081, Aug. 8, 2011, Office Action.
U.S. Appl. No. 12/271,081, Oct. 5, 2011, Notice of Allowance.
U.S. Appl. No. 12/363,104, Oct. 14, 2010, Office Action.
U.S. Appl. No. 12/363,104, Apr. 12, 2011, Office Action.
U.S. Appl. No. 12/363,104, Aug. 25, 2011, Notice of Allowance.
U.S. Appl. No. 12/394,356, Sep. 1, 2011, Notice of Allowance.
U.S. Appl. No. 12/394,356, Nov. 30, 2011, Issue Notification.
U.S. Appl. No. 12/397,969, May 25, 2012, Notice of Allowance.
U.S. Appl. No. 12/397,969, Nov. 14, 2012, Issue Notification.
U.S. Appl. No. 12/548,584, May 18, 2012, Office Action.
U.S. Appl. No. 12/548,584, Oct. 24, 2012, Office Action.
U.S. Appl. No. 12/548,584, Jan. 3, 2013, Office Action.
U.S. Appl. No. 12/548,584, Jun. 14, 2013, Office Action.
U.S. Appl. No. 12/548,584, Sep. 26, 2013, Office Action.
U.S. Appl. No. 13/032,350, Nov. 26, 2012, Office Action.
U.S. Appl. No. 13/032,350, Mar. 14, 2013, Office Action.
U.S. Appl. No. 13/032,350, Sep. 30, 2013, Office Action.
U.S. Appl. No. 13/100,388, Oct. 18, 2013, Office Action.
U.S. Appl. No. 13/171,735, Aug. 17, 2012, Office Action.
U.S. Appl. No. 13/171,735, Jan. 24, 2013, Office Action.
U.S. Appl. No. 13/171,735, Jul. 12, 2013, Office Action.
U.S. Appl. No. 13/230,125, May 23, 2012, Office Action.
U.S. Appl. No. 13/230,125, Jul. 11, 2012, Office Action.
U.S. Appl. No. 13/230,125, Jan. 18, 2013, Office Action.
U.S. Appl. No. 13/230,125, May 1, 2013, Notice of Allowance.
U.S. Appl. No. 13/230,125, Aug. 21, 2013, Issue Notification.
U.S. Appl. No. 13/285,198, Apr. 3, 2012, Office Action.
U.S. Appl. No. 13/285,198, Jul. 11, 2012, Office Action.
U.S. Appl. No. 13/285,198, Feb. 5, 2013, Notice of Allowance.
U.S. Appl. No. 13/285,198, Jul. 22, 2013, Notice of Allowance.
U.S. Appl. No. 13/292,491, Aug. 8, 2012, Office Action.
U.S. Appl. No. 13/292,491, Feb. 11, 2013, Office Action.
U.S. Appl. No. 13/292,491, Jul. 18, 2013, Office Action.
U.S. Appl. No. 13/027,954, Jul. 18, 2013, Office Action.
U.S. Appl. No. 13/690,397, Feb. 14, 2013, Office Action.
U.S. Appl. No. 13/690,397, May 29, 2013, Notice of Allowance.
U.S. Appl. No. 13/690,397, Aug. 9, 2013, Office Action.
U.S. Appl. No. 13/917,952, Jul. 31, 2013, Office Action.
U.S. Appl. No. 13/292,900, May 23, 2013, Office Action.
U.S. Appl. No. 13/292,900, Oct. 22, 2013, Notice of Allowance.
U.S. Appl. No. 12/961,787, May 29, 2013, Office Action.
U.S. Appl. No. 12/961,787, Aug. 30, 2013, Office Action.
U.S. Appl. No. 13/323,138, Oct. 1, 2013, Office Action.
U.S. Appl. No. 13/953,453, Sep. 19, 2013, Office Action.
U.S. Appl. No. 13/953,453, Oct. 10, 2013, Office Action.
U.S. Appl. No. 14/178,118, filed Feb. 11, 2014, Mukhopadhyay et al.
Decker, et al., "High-Pressure Calibration: A Critical Review," J. Phys. Chem. Ref. Data, 1, 3 (1972).
Rousse, et al. "Structure of the Intermediate Phase of PbTe at High Pressure," Physical Review B: Condensed Matter and Materials Physics, 71, 224116 (2005).
U.S. Appl. No. 12/548,584, Mar. 6, 2014, Notice of Allowance.

(56) References Cited

OTHER PUBLICATIONS

U.S. Appl. No. 13/100,388, Jan. 15, 2014, Office Action.
U.S. Appl. No. 13/171,735, Jan. 10, 2014, Office Action.
U.S. Appl. No. 13/292,491, Mar. 21, 2014, Office Action.
U.S. Appl. No. 13/027,954, Mar. 10, 2014, Office Action.
U.S. Appl. No. 13/690,397, Mar. 12, 2014, Notice of Allowance.
U.S. Appl. No. 13/917,952, Feb. 26, 2014, Notice of Allowance.
U.S. Appl. No. 13/292,900, Jan. 30, 2014, Notice of Allowance.
U.S. Appl. No. 13/323,138, Mar. 12, 2014, Notice of Allowance.
U.S. Appl. No. 13/953,453, Mar. 18, 2014, Office Action.
U.S. Appl. No. 12/961,787, Dec. 3, 2015, Office Action
U.S. Appl. No. 14/178,188, Sep. 10, 2015, Office Action.
U.S. Appl. No. 14/178,118, Jan. 22, 2016, Office Action.
U.S. Appl. No. 14/570,506, Sep. 15, 2015, Office Action.
U.S. Appl. No. 14/297,359, Oct. 30, 2015, Notice of Allowance.
U.S. Appl. No. 14/327,264, Nov. 6, 2015, Office Action.
U.S. Appl. No. 14/330,851, Nov. 12, 2015, Office Action.
U.S. Appl. No. 14/495,759, Jan. 20, 2016, Office Action.
U.S. Appl. No. 14/178,118, Sep. 28, 2016, Non-Final Office Action.
U.S. Appl. No. 14/495,759, Oct. 3, 2016, Notice of Allowance.
U.S. Appl. No. 14/570,506, Nov. 22, 2016, Notice of Allowance.
U.S. Appl. No. 14/330,851, Dec. 29, 2016, Final Office Action.
U.S. Appl. No. 12/961,787, Jun. 17, 2016, Office Action.
U.S. Appl. No. 14/178,118, May 27, 2016, Advisory Action.
U.S. Appl. No. 14/570,506, Dec. 16, 2015, Interview Summary.
U.S. Appl. No. 14/570,506, Mar. 1, 2016, Office Action.
U.S. Appl. No. 14/570,506, May 25, 2016, Interview Summary.
U.S. Appl. No. 14/570,506, Aug. 10, 2016, Notice of Allowance.
U.S. Appl. No. 14/297,359, Mar. 14, 2016, Notice of Allowance.
U.S. Appl. No. 14/297,359, Jun. 15, 2016, Issue Notification.
U.S. Appl. No. 14/327,264, May 26, 2016, Notice of Allowance.
U.S. Appl. No. 14/327,264, Jun. 8, 2016, Issue Notification.
U.S. Appl. No. 14/330,851, Jul. 14, 2016, Office Action.
U.S. Appl. No. 14/495,759, May 25, 2016, Office Action.
U.S. Appl. No. 14/633,041, Apr. 11, 2016, Office Action.
U.S. Appl. No. 14/614,332, Jul. 1, 2016, Office Action.
U.S. Appl. No. 14/634,395, Jul. 29, 2016, Office Action.
U.S. Appl. No. 14/504,253, Aug. 25, 2016, Office Action.
U.S. Appl. No. 14/634,395, Apr. 19, 2017, Issue Notification.
U.S. Appl. No. 14/495,759, May 10, 2017, Issue Notification.
U.S. Appl. No. 12/961,787, Jan. 17, 2017, Office Action.
U.S. Appl. No. 14/178,118, Mar. 24, 2017, Office Action.
U.S. Appl. No. 14/570,506, Mar. 17, 2017, Notice of Allowance.
U.S. Appl. No. 14/570,506, Mar. 29, 2017, Issue Notification.
U.S. Appl. No. 14/495,759, Feb. 8, 2017, Notice of Allowance.
U.S. Appl. No. 14/614,332, Jan. 13, 2017, Office Action.
U.S. Appl. No. 14/634,395, Jan. 11, 2017, Notice of Allowance.
U.S. Appl. No. 14/634,395, Jan. 26, 2017, Notice of Allowance.
U.S. Appl. No. 14/661,993, Oct. 26, 2016, Restriction Requirement.
U.S. Appl. No. 14/661,993, Feb. 16, 2017, Office Action.
U.S. Appl. No. 14/621,019, Mar. 30, 2017, Restriction Requirement.
U.S. Appl. No. 14/327,264, Feb 2, 2016, Notice of Allowance.
U.S. Appl. No. 14/512,007, Feb. 2, 2016, Office Action.
U.S. Appl. No. 14/570,506, Dec. 15, 2014, Meiss et al.
U.S. Appl. No. 14/614,332, Feb. 8, 2015, Bertagnolli et al.
U.S. Appl. No. 14/621,019, Feb. 12, 2015, Jones et al.
U.S. Appl. No. 14/633,041, Feb. 26, 2015, Miess et al.
U.S. Appl. No. 14/634,395, Feb. 27, 2015, Miess et al.
U.S. Appl. No. 14/661,993, Mar. 18, 2015, Sani.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 13/100,388, Nov. 7, 2014, Notice of Allowance.
U.S. Appl. No. 13/100,388, Dec. 24, 2014, Notice of Allowance.
U.S. Appl. No. 13/100,388, Mar. 4, 2015, Notice of Allowance.
U.S. Appl. No. 13/100,388, Apr. 13, 2015, Notice of Allowance.
U.S. Appl. No. 13/100,388, Apr. 22, 2015, Issue Notification.
U.S. Appl. No. 13/292,491, Nov. 3, 2014, Office Action.
U.S. Appl. No. 13/292,491, Dec. 19, 2014, Notice of Allowance.
U.S. Appl. No. 13/292,491, Apr. 15, 2015, Issue Notification.
U.S. Appl. No. 13/027,954, Dec. 26, 2014, Notice of Allowance.
U.S. Appl. No. 13/027,954, Apr. 8, 2015, Issue Notification.
U.S. Appl. No. 12/961,787, May 21, 2015, Office Action.
U.S. Appl. No. 13/323,138, Nov. 25, 2014, Issue Notification.
U.S. Appl. No. 13/397,971, Nov. 26, 2014, Notice of Allowance.
U.S. Appl. No. 13/397,971, Mar. 19, 2015, Issue Notification.
U.S. Appl. No. 13/953,453, Feb. 12, 2015, Notice of Allowance.
U.S. Appl. No. 13/953,453, Feb. 25, 2015, Issue Notification.
U.S. Appl. No. 12/961,787, Jun. 1, 2017, Advisory Action.
U.S. Appl. No. 14/621,019, May 19, 2017, Non-Final Office Action.
U.S. Appl. No. 12/961,787, Oct. 5, 2017, Office Action.
U.S. Appl. No. 14/178,118, Jul. 28, 2017, Office Action.
U.S. Appl. No. 14/330,851 Aug. 10, 2017, Office Action.
U.S. Appl. No. 14/614,332, Aug. 15, 2017, Office Action.
U.S. Appl. No. 14/178,118, Oct. 6, 2017, Office Action.
U.S. Appl. No. 14/661,993, Jun. 22, 2017, Notice of Allowance.
U.S. Appl. No. 14/661,993, Oct. 18, 2017, Issue Notification.

* cited by examiner

SUPERABRASIVE ELEMENTS, METHODS OF MANUFACTURING, AND DRILL BITS INCLUDING SAME

CROSS-REFERENCE TO RELATED APPLICATIONS

This application is a continuation of application Ser. No. 12/548,584 filed on 27 Aug. 2009, which is a divisional of application Ser. No. 11/545,929 filed on 10 Oct. 2006, the disclosure of each of the foregoing applications is incorporated herein, in its entirety, by this reference.

BACKGROUND

Wear resistant compacts comprising superabrasive material are utilized for a variety of applications and in a corresponding variety of mechanical systems. For example, wear resistant superabrasive elements are used in drilling tools (e.g., inserts, cutting elements, gage trimmers, etc.), machining equipment, bearing apparatuses, wire drawing machinery, and in other mechanical systems.

In one particular example, polycrystalline diamond compacts have found particular utility as cutting elements in drill bits (e.g., roller cone drill bits and fixed cutter drill bits) and as bearing surfaces in so-called "thrust bearing" apparatuses. A polycrystalline diamond compact ("PDC") cutting element or cutter typically includes a diamond layer or table formed by a sintering process employing high-temperature and high-pressure conditions that causes the diamond table to become bonded to a substrate (e.g., a cemented tungsten carbide substrate), as described in greater detail below.

When a polycrystalline diamond compact is used as a cutting element, it may be mounted to a drill bit either by press-fitting, brazing, or otherwise coupling the cutting element into a receptacle defined by the drill bit, or by brazing the substrate of the cutting element directly into a preformed pocket, socket, or other receptacle formed in the drill bit. In one example, cutter pockets may be formed in the face of a matrix-type bit comprising tungsten carbide particles that are infiltrated or cast with a binder (e.g., a copper-based binder), as known in the art. Such drill bits are typically used for rock drilling, machining of wear resistant materials, and other operations which require high abrasion resistance or wear resistance. Generally, a rotary drill bit may include a plurality of polycrystalline abrasive cutting elements affixed to a drill bit body.

A PDC is normally fabricated by placing a layer of diamond crystals or grains adjacent one surface of a substrate and exposing the diamond grains and substrate to an ultra-high pressure and ultra-high temperature ("HPHT") process. Thus, a substrate and adjacent diamond crystal layer may be sintered under ultra-high temperature and ultra-high pressure conditions to cause the diamond crystals or grains to bond to one another. In addition, as known in the art, a catalyst may be employed for facilitating formation of polycrystalline diamond. In one example, a so-called "solvent catalyst" may be employed for facilitating the formation of polycrystalline diamond. For example, cobalt, nickel, and iron are among examples of solvent catalysts for forming polycrystalline diamond. In one configuration, during sintering, solvent catalyst from the substrate body (e.g., cobalt from a cobalt-cemented tungsten carbide substrate) becomes liquid and sweeps from the region behind the substrate surface next to the diamond powder and into the diamond grains. Of course, a solvent catalyst may be mixed with the diamond powder prior to sintering, if desired. Also, as known in the art, such a solvent catalyst may dissolve carbon at high temperatures. Such carbon may be dissolved from the diamond grains or portions of the diamond grains that graphitize due to the high temperatures of sintering. The solubility of the stable diamond phase in the solvent catalyst is lower than that of the metastable graphite under HPHT conditions. As a result of this solubility difference, the undersaturated graphite tends to dissolve into solution; and the supersaturated diamond tends to deposit onto existing nuclei to form diamond-to-diamond bonds. The supersaturated diamond may also nucleate new diamond crystals in the molten solvent catalyst creating additional diamond-to-diamond bonds. Thus, the diamond grains become mutually bonded to form a polycrystalline diamond table upon the substrate. The solvent catalyst may remain in the diamond layer within the interstitial space between the diamond grains or the solvent catalyst may be at least partially removed and optionally replaced by another material, as known in the art. For instance, the solvent catalyst may be at least partially removed from the polycrystalline diamond by acid leaching. One example of a conventional process for forming polycrystalline diamond compacts, is disclosed in U.S. Pat. No. 3,745,623 to Wentorf, Jr. et al., the disclosure of which is incorporated herein, in its entirety, by this reference.

It may be appreciated that it would be advantageous to provide methods for forming superabrasive materials and apparatuses, structures, or articles of manufacture including such superabrasive material.

SUMMARY

One aspect of the instant disclosure relates to a method of manufacturing a superabrasive element. More particularly, a substrate, a preformed superabrasive volume, and a braze material may be provided and at least partially surrounded by an enclosure. Further, the enclosure may be sealed in an inert environment. The enclosure may be exposed to a pressure of at least about 60 kilobar, and the braze material may be at least partially melted. In another embodiment, a method of manufacturing a superabrasive element may comprise providing a substrate and a preformed superabrasive volume and positioning the substrate and preformed superabrasive volume at least partially within an enclosure. Further, the enclosure may be sealed in an inert environment and the enclosure may be exposed to a pressure of at least about 60 kilobar.

Another aspect of the present invention relates to a superabrasive element. More specifically, a superabrasive element may comprise a preformed superabrasive volume bonded to a substrate. In further detail, the preformed superabrasive volume may be bonded to the substrate by a method comprising providing the substrate, the preformed superabrasive volume, and a braze material and at least partially surrounding the substrate, the preformed superabrasive volume, and a braze material within an enclosure. Also, the enclosure may be sealed in an inert environment. Further, the enclosure may be exposed to a pressure of at least about 60 kilobar and, optionally concurrently, the braze material may be at least partially melted. Subterranean drill bits including at least one of such a superabrasive element are also contemplated. Another aspect of the present invention relates to a superabrasive element. For instance, a superabrasive element may comprise a preformed superabrasive volume bonded to a substrate by a braze material, wherein the preformed superabrasive volume exhibits a compressive stress.

Any of the aspects described in this application may be applicable to a polycrystalline diamond element or method of forming or manufacturing a polycrystalline diamond element. For example, a method of manufacturing a polycrystalline diamond element may comprise: providing a substrate and a preformed polycrystalline diamond volume; and at least partially enclosing the substrate and the preformed superabrasive volume. Further, the enclosure may be sealed in an inert environment and the preformed superabrasive volume may be affixed to the substrate. Optionally, the preformed superabrasive volume may be affixed to the substrate while exposing the enclosure to an elevated pressure.

Subterranean drill bits or other subterranean drilling or reaming tools including at least one of any superabrasive element encompassed by this application are also contemplated by the present invention. For example, the present invention contemplates that any rotary drill bit for drilling a subterranean formation may include at least one cutting element encompassed by the present invention. For example, a rotary drill bit may comprise a bit body including a leading end having generally radially extending blades structured to facilitate drilling of a subterranean formation. In one embodiment, a rotary drill bit may include at least one cutting element comprising a preformed superabrasive volume bonded to a substrate by a braze material, wherein the preformed superabrasive volume exhibits a compressive residual stress. In another embodiment, a drill bit may include a bit body comprising a leading end having generally radially extending blades structured to facilitate drilling of a subterranean formation. Further, the drill bit may include a cutting element comprising a preformed superabrasive volume bonded to a substrate by a braze material, wherein the preformed superabrasive volume exhibits a compressive residual stress. More generally, a drill bit or drilling tool may include a superabrasive cutting element wherein a preformed superabrasive volume is bonded to the substrate by any method for forming or manufacturing a superabrasive element encompassed by this application.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

Figure 1:
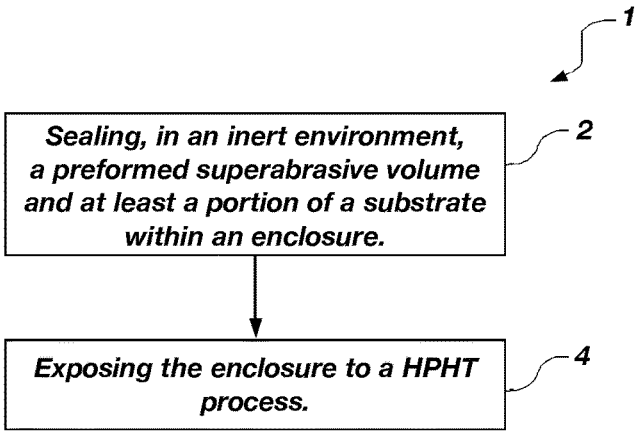
FIG. 1 shows a schematic diagram of one embodiment of a method for forming a superabrasive element according to the present invention.

The present invention relates generally to structures comprising at least one superabrasive material (e.g., diamond, cubic boron nitride, silicon carbide, mixtures of the foregoing, or any material exhibiting a hardness exceeding a hardness of tungsten carbide) and methods of manufacturing such structures. More particularly, the present invention relates to a preformed (i.e., sintered) superabrasive mass or volume that is bonded to a substrate. The phrase "preformed superabrasive volume," as used herein, means a mass or volume comprising at least one superabrasive material which has been at least partially bonded or at least partially sintered to form a coherent structure or matrix. For example, polycrystalline diamond may be one embodiment of a preformed superabrasive volume. In another example, a superabrasive material as disclosed in U.S. Pat. No. 7,060,641, filed 19 Apr. 2005 and entitled "Diamond-silicon carbide composite," the disclosure of which is incorporated herein, in its entirety, by this reference may comprise a preformed superabrasive volume.

Generally, the present invention relates to methods and structures related to sealing a superabrasive in an inert environment. The phrase "inert environment," as used herein, means an environment that inhibits oxidation. Explaining further, an inert environment may be, for instance, at least substantially devoid of oxygen. A vacuum (i.e., generating a pressure less than an ambient atmospheric pressure) is one example of an inert environment. Creating a surrounding environment comprising a noble or inert gas such that oxidation is inhibited is another example of an inert environment. Thus, those skilled in the art will appreciate that the inert environment is not limited to a vacuum. Inert gases, such as argon, nitrogen, or helium, in suitable concentrations may provide an oxidation-inhibiting environment. Of course, the inert gases listed above serve merely to illustrate the concept and in no way constitute an exhaustive list. Further, gasses, liquids, and/or solids may (in selected combination or taken alone) may form an inert environment, without limitation.

In one embodiment of a method of manufacturing a superabrasive element, a preformed superabrasive volume and a substrate may be exposed to a HPHT process within an enclosure that is hermetically sealed in an inert environment prior to performing the HPHT process. Such a method may be employed to form a superabrasive element with desirable characteristics. For instance, in one embodiment, such a process may allow for bonding of a so-called "thermally-stable" product ("TSP") or thermally-stable diamond ("TSD") to a substrate to form a polycrystalline diamond element. Such a polycrystalline diamond element may exhibit a desirable residual stress field and desirable thermal stability characteristics.

As described above, manufacturing polycrystalline diamond involves the compression of diamond particles under extremely high pressure. Such compression may occur at room temperature, at least initially, and may result in the reduction of void space in the diamond powder due to brittle crushing, sliding, stacking, and/or otherwise consolidating of the diamond particles. Thus, the diamond particles may sustain very high local pressures where they contact one another, but the pressures experienced on noncontacting surfaces of the diamond particles and in the interstitial voids may be, comparatively, low. Manufacturing polycrystalline diamond further involves heating the diamond particles. Such heating may increase the temperature of the diamond powder from room temperature at least to the melting point of a solvent catalyst. Portions of the diamond particles under high local pressures may remain diamond, even at elevated temperatures. However, regions of the diamond particles that are not under high local pressure may begin to graphitize as temperature of such regions increases. Further, as a solvent-catalyst melts, it may infiltrate or "sweep" through the diamond particles. In addition, as known in the art, a solvent catalyst (e.g., cobalt, nickel, iron, etc.) may dissolve and transport carbon between the diamond grains and facilitate diamond formation. Thus, the presence of solvent catalyst may facilitate the formation of diamond-to-diamond bonds in the sintered polycrystalline diamond material, resulting in formation of a coherent skeleton or matrix of bonded diamond particles or grains.

Further, manufacturing polycrystalline diamond may involve compressing under extremely high pressure a mixtures of diamond particles and elements or alloys containing elements which react with carbon to form stable carbides to act as a bonding agent for the diamond particles. Materials such as silicon, titanium, tungsten, molybdenum, niobium, tantalum, zirconium, hafnium, chromium, vanadium, scandium, and boron and others would be suitable bonding agents. Such compression may occur at room temperature, at least initially, and may result in the reduction of void space in the diamond mixture due to brittle crushing, sliding, stacking, and/or otherwise consolidating of the diamond particles. Thus, the diamond particles may sustain very high local pressures where they contact one another, but the pressures experienced on noncontacting surfaces of the diamond particles and in the interstitial voids may be, comparatively, low. Manufacturing polycrystalline diamond further involves heating the diamond mixture. Such heating may increase the temperature of the diamond mixture from room temperature at least to the melting point of the bonding agent. Portions of the diamond particles under high local pressures may remain diamond, even at elevated temperatures. However, regions of the diamond particles that are not under high local pressure may begin to graphitize as temperature of such regions increases. Further, as the bonding agent melts, it may infiltrate or "sweep" through the diamond particles. Because of their affinity for carbon, the bonding agent elements react extensively or completely with the diamonds to form interstitial carbide phases at the interfaces which provide a strong bond between the diamond crystals. Moreover, any graphite formed during the heating process is largely or completely converted into stable carbide phases as fast as it is formed. This stable carbide phase surrounds individual diamond crystals and bonds them to form a dense, hard compact. As mentioned above, one example of such a superabrasive material is disclosed in U.S. Pat. No. 7,060,641.

One aspect of the present invention relates to affixing a preformed superabrasive volume to a substrate. More particularly, the present invention contemplates that one embodiment of a method of manufacturing may comprise providing a preformed superabrasive volume and a substrate and sealing the preformed superabrasive volume and at least a portion of the substrate within an enclosure in an inert environment. Put another way, a preformed superabrasive volume and at least a portion of a substrate may be encapsulated within an enclosure and in an inert environment. Further, the method may further comprise affixing the preformed superabrasive volume to the substrate while exposing the enclosure to an elevated pressure (i.e., any pressure exceeding an ambient atmospheric pressure; e.g., exceeding about 20 kilobar, at least about 60 kilobar, or between about 20 kilobar and about 60 kilobar). Generally, any method of affixing the preformed superabrasive volume to the substrate may be employed.

In one embodiment, subsequent to enclosing and sealing the preformed superabrasive volume and at least a portion of the substrate within the enclosure, the enclosure may be subjected to a HPHT process. Generally, a HPHT process includes developing an elevated pressure and an elevated temperature. As used herein, the phrase "HPHT process" means to generate a pressure of at least about 20 kilobar and a temperature of at least about 800° Celsius. In one example, a pressure of at least about 60 kilobar may be developed. Regarding temperature, in one example, a temperature of at least about 1,350° Celsius may be developed. Further, such a HPHT process may cause the preformed superabrasive volume to become affixed to the substrate. For example, a braze material may also be enclosed within the enclosure and may be at least partially melted during the HPHT process to affix the superabrasive volume to the substrate upon cooling of the braze material.

One aspect of the present invention contemplates that a preformed superabrasive volume and at least a portion of a substrate may be sealed, in an inert environment, within an enclosure. Generally, any methods or systems may be employed for sealing, in an inert environment, a preformed superabrasive volume and at least a portion of a substrate within an enclosure. For example, U.S. Pat. No. 4,333,902 to Hara, the disclosure of which is incorporated, in its entirety, by this reference, and U.S. patent application Ser. No. 10/654,512 to Hall, et al., filed 3 Sep. 2003, the disclosure of which is incorporated, in its entirety, by this reference, each disclose methods and systems related to sealing an enclosure in an inert environment.

For example, FIG. 1 shows a schematic diagram representing a manufacturing method for forming a superabrasive element. As shown in FIG. 1, a preformed superabrasive volume and at least a portion of a substrate may be sealed, in an inert environment, within an enclosure. Further, the enclosure may be exposed to a HPHT process. Thus, in general, method 1 may comprise a sealing action 2 and a HPHT process 4. During the HPHT process 4, at least one constituent (e.g., a metal) of the substrate and/or the preformed superabrasive volume may at least partially melt. Further, upon cooling, the preformed superabrasive volume may be affixed to the substrate.

Optionally, such a process may generate a residual stress field within each of the superabrasive volume and the substrate. Explaining further, a coefficient of thermal expansion of a superabrasive material may be substantially less than a coefficient of expansion of a substrate. In one example, a preformed superabrasive volume may comprise a preformed polycrystalline diamond volume and a substrate may comprise cobalt-cemented tungsten carbide. The present invention contemplates that selectively controlling the temperature and/or pressure during a HPHT process may allow for selectively tailoring a residual stress field developed within a preformed superabrasive volume and/or a substrate to which the superabrasive volume is affixed. Furthermore, the presence of a residual stress field developed within the superabrasive and/or the substrate may be beneficial.

Figure 2:
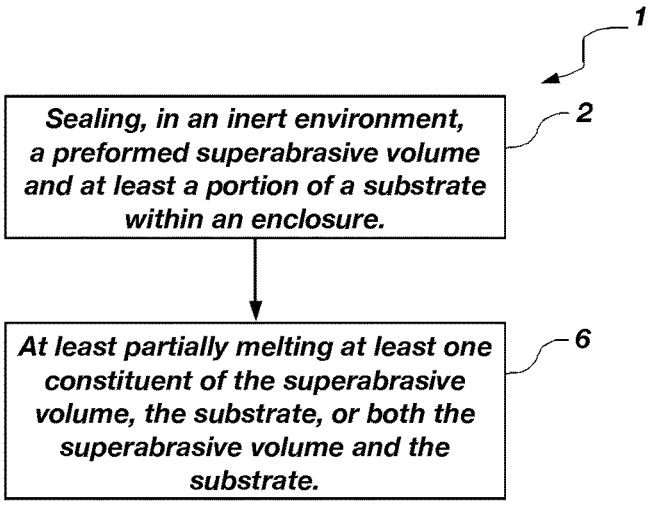
FIG. 2 shows a schematic diagram of another embodiment of a method for forming a superabrasive element according to the present invention.

FIG. 2 shows a schematic diagram representing another embodiment of a method 1 for forming a superabrasive element, the method comprising a sealing action 2 and a heating action 6. As shown in FIG. 2, sealing action 2 may include sealing, in an inert environment, a preformed superabrasive volume and at least a portion of a substrate within an enclosure. Further, at least one constituent of the preformed superabrasive volume, the substrate, or both may be at least partially melted. At least partially melting of such at least one constituent may cause the preformed superabrasive volume to be affixed or bonded to the substrate. Such a method 1 may be relatively effective for bonding a preformed superabrasive volume to a substrate.

Figure 3:
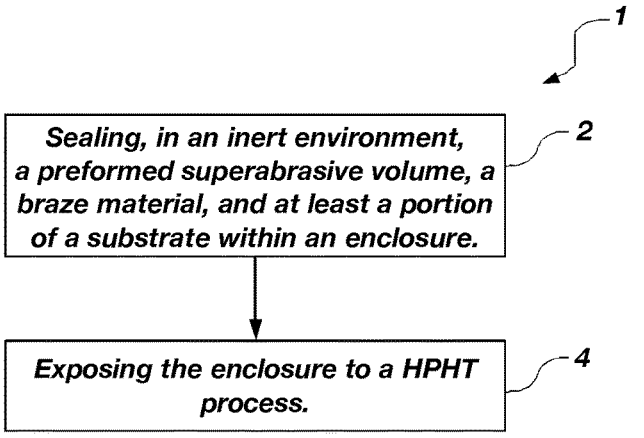
FIG. 3 shows a schematic diagram of an additional embodiment of a method for forming a superabrasive element according to the present invention.

Another aspect of the present invention relates to bonding or affixing a preformed superabrasive volume to a substrate by at least partially melting a braze material. For example, FIG. 3 shows a further embodiment of a manufacturing method 1 for forming a superabrasive element, the method comprising a sealing action 2 and a HPHT process 4. As shown in FIG. 3, sealing action 2 may include sealing, in an inert environment, a preformed superabrasive volume, a braze material and at least a portion of a substrate within an enclosure. Relative to polycrystalline diamond, exemplary diamond brazes may be referred to as "Group Ib solvents" (e.g., copper, silver, and gold) and may optionally contain one or more carbide former (e.g., titanium, vanadium, chromium, manganese, zirconium, niobium, molybdenum, technetium, hafnium, tantalum, tungsten, or rhenium, without limitation). Accordingly, exemplary compositions may include gold-tantalum Au—Ta, silver-copper-titanium (Ag—Cu—Ti), or any mixture of any Group Ib solvent(s) and, optionally, one or more carbide former. Other suitable braze materials may include a metal from Group VIII in the periodic table, (e.g., iron, cobalt, nickel, ruthenium, rhodium, palladium, osmium, iridium, and/or platinum, or alloys/mixtures thereof, without limitation). In one embodiment, a braze material may comprise an alloy of about 4.5% titanium, about 26.7% copper, and about 68.8% silver, otherwise known as TICUSIL®, which is currently commercially available from Wesgo Metals, Hayward, Calif. In a further embodiment, a braze material may comprise an alloy of about 25% silver, about 37% copper, about 10% nickel, about 15% palladium, and about 13% manganese, otherwise known as PALNICUROM® 10, which is also currently commercially available from Wesgo Metals, Hayward, Calif. In an additional embodiment, a braze material may comprise an alloy of about 64% iron and about 36% nickel, commonly referred to as Invar. In yet a further embodiment, a braze material may comprise a single metal such as for example, cobalt. Sealing action 2, in an inert environment, may provide a beneficial environment for proper functioning of the braze alloy. In particular, sealing action 2, in an inert environment at least substantially eliminates oxygen from the braze joint, which may significantly improve the strength of the bond. Further, the superabrasive volume, braze material, and substrate may be exposed to a HPHT process 4. Such a HPHT process 4 may cause the superabrasive volume to be affixed to the substrate via the braze material. Furthermore, such a method 1 may provide a beneficial residual stress field as described above.

Figure 4:
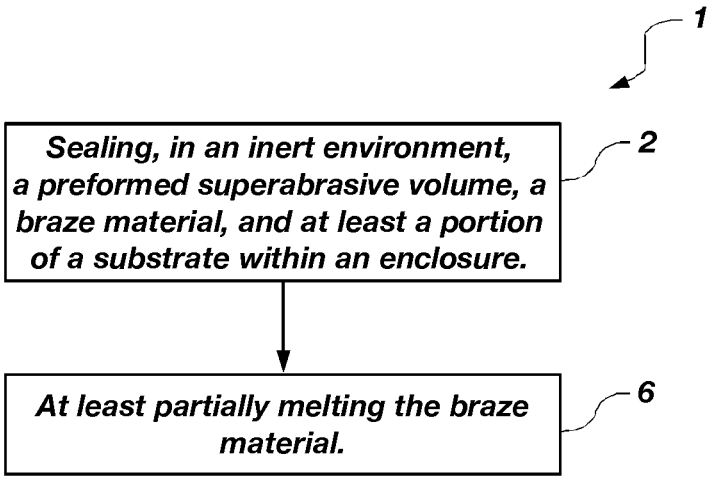
FIG. 4 shows a schematic diagram of a further embodiment of a method for forming a superabrasive element according to the present invention.

In a further example, FIG. 4 shows a schematic diagram representing an additional manufacturing method 1 for forming a superabrasive element. Particularly, as shown in FIG. 4, manufacturing method 1 includes a sealing action 2 and a heating action 6. Sealing action 2 may include sealing, in an inert environment, a preformed superabrasive volume, a braze material, and at least a portion of a substrate. Furthermore, the braze material may be at least partially melted by heating action 6. Such a heating action 6, in combination with cooling of the braze material to cause solidification of the braze material, may cause the superabrasive volume to be affixed to the substrate via the braze material.

Figure 5:
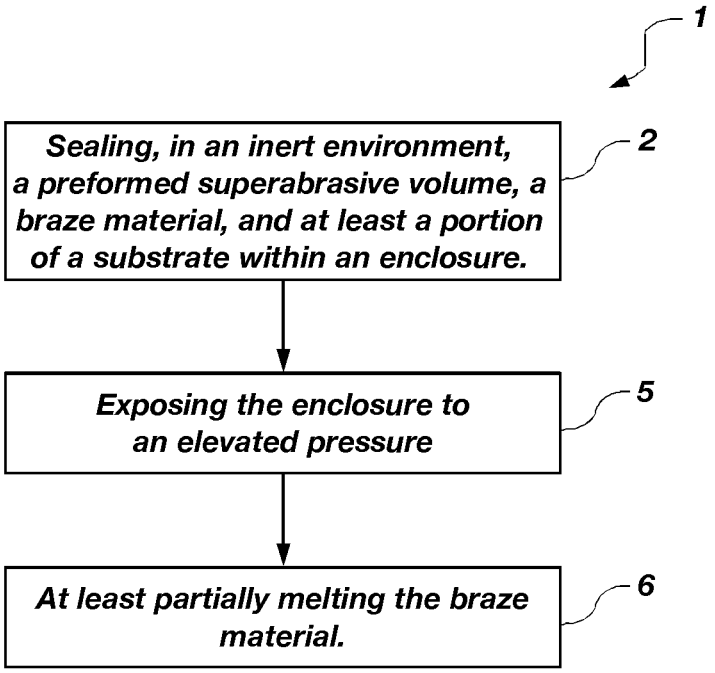
FIG. 5 shows a schematic diagram of yet another embodiment of a method for forming a superabrasive element according to the present invention.

In another example, FIG. 5 shows a schematic diagram representing an additional manufacturing method 1 for forming a superabrasive element, the method 1 comprising a sealing action 2, a pressurization action 5, and a heating action 6. As shown in FIG. 5, a preformed superabrasive volume, a braze material, and at least a portion of a substrate may be sealed in an inert environment within an enclosure. In addition, the enclosure may be exposed to an elevated pressure. More particularly, the enclosure may be exposed to a pressure exceeding an ambient atmospheric pressure (e.g., at least about 60 kilobar). Further, the braze material may be at least partially melted. Optionally, the braze material may be at least partially melted while the elevated pressure is applied to the enclosure. In one embodiment, a braze material may exhibit a melting temperature of about 900° Celsius in the case of TICUSIL®. In another embodiment, a braze material may exhibit a melting temperature of about 1013° Celsius in the case of PALNICUROM® 10. In a further embodiment, a braze material may exhibit a melting temperature of about 1427° Celsius in the case of Invar. In yet a further embodiment, a braze material may exhibit a melting temperature of about 1493° Celsius in the case of cobalt. One of ordinary skill in the art will understand that the actual melting temperature of a braze material is dependent on the pressure applied to the braze material and the composition of the braze material. Accordingly, the values listed above are merely for reference.

Of course, the braze material may be at least partially melted during exposure of the enclosure to an elevated pressure. In addition, the braze material may be cooled (i.e., at least partially solidified) while the enclosure is exposed to the selected, elevated pressure (e.g., exceeding about 20 kilobar, at least about 60 kilobar, or between about 20 kilobar and about 60 kilobar). Such sealing action 2, pressurization action 5, and heating action 6 may affix or bond the preformed superabrasive volume to the substrate. Moreover, solidifying the braze material while the enclosure is exposed to an elevated pressure exceeding an ambient atmospheric pressure may develop a selected level of residual stress within the superabrasive element upon cooling to ambient temperatures and upon release of the elevated pressure.

The present invention contemplates that an article of manufacture comprising a superabrasive volume may be manufactured by performing the above-described processes or variants thereof. In one example, apparatuses including polycrystalline diamond may be useful for cutting elements, heat sinks, wire dies, and bearing apparatuses, without limitation. Accordingly, a preformed superabrasive volume may comprise preformed polycrystalline diamond. Thus, a preformed polycrystalline diamond volume may be formed by any suitable process, without limitation. Optionally, such a preformed polycrystalline diamond volume may be a so-called "thermally stable" polycrystalline diamond material. For example, a catalyst material (e.g., cobalt, nickel, iron, or any other catalyst material), which may be used to initially form the polycrystalline diamond volume, may be at least partially removed (e.g., by acid leaching or as otherwise known in the art) from the polycrystalline diamond volume. In one embodiment, a preformed polycrystalline diamond volume that is substantially free of a catalyzing material may be affixed or bonded to a substrate. Such a polycrystalline diamond apparatus may exhibit desirable wear characteristics. In addition, as described above, such a polycrystalline diamond apparatus may exhibit a selected residual stress field that is developed within the polycrystalline diamond volume and/or the substrate.

Figure 6:
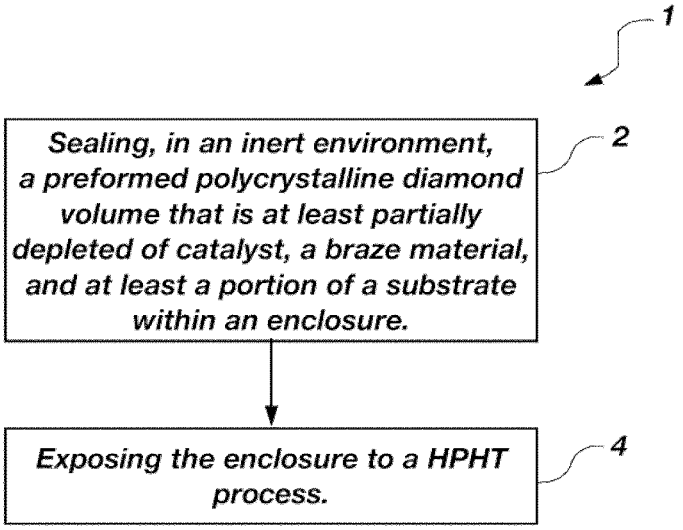
FIG. 6 shows a schematic diagram of one embodiment of a method for forming a polycrystalline diamond element according to the present invention.

FIG. 6 shows a schematic diagram of one embodiment of a method 1 for forming a polycrystalline diamond element, the method 1 comprising a sealing action 2 and a HPHT process 4. As shown in FIG. 6, sealing action 2 may include sealing, in an inert environment, a preformed polycrystalline diamond volume, a braze material, and at least a portion of a substrate. Further, the superabrasive volume, braze material, and substrate may be exposed to a HPHT process 4. Such a HPHT process 4 may cause the polycrystalline diamond volume to be affixed to the substrate via the braze material. Furthermore, a polycrystalline diamond element so formed may exhibit the beneficial residual stress characteristics described above.

Figure 7:
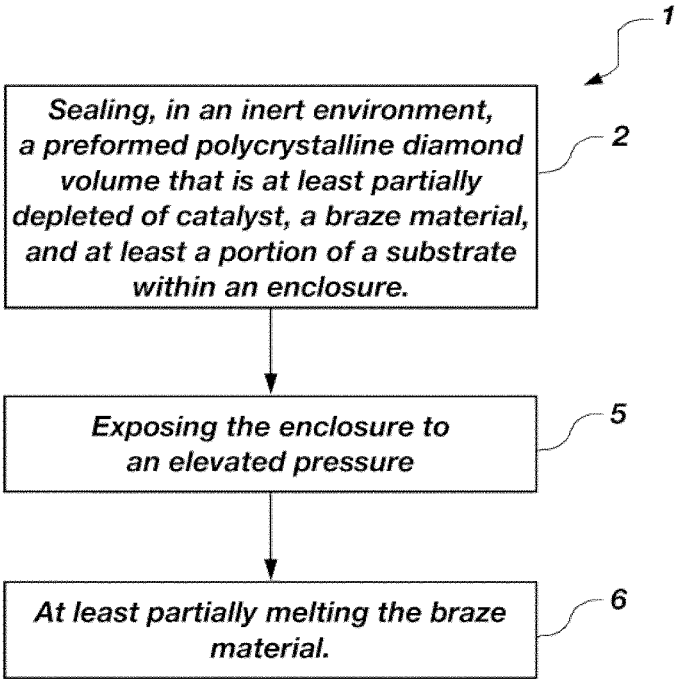
FIG. 7 shows a schematic diagram of another embodiment of a method for forming a superabrasive element according to the present invention.

FIG. 7 shows a schematic diagram representing another embodiment of a method 1 for forming a polycrystalline diamond element, the method 1 comprising a sealing action 2, a pressurization action 5, and a heating action 6. As shown in FIG. 7, a preformed polycrystalline diamond volume, a braze material, and at least a portion of a substrate may be sealed in an inert environment within an enclosure. In addition, the enclosure may be exposed to an elevated pressure. More particularly, the enclosure may be exposed to a pressure exceeding an ambient atmospheric pressure (e.g., exceeding about 20 kilobar, at least about 60 kilobar, or between about 20 kilobar and about 60 kilobar). Further, the braze material may be at least partially melted. Of course, the braze material may be at least partially melted during exposure of the enclosure to an elevated pressure, prior to such exposure, after such exposure, or any combination of the foregoing. In addition, the braze material may be solidified while the enclosure is exposed to a selected, elevated pressure (e.g., exceeding about 20 kilobar, at least about 60 kilobar, or between about 20 kilobar and about 60 kilobar). In other embodiments, the braze material may be solidified prior to such exposure, after such exposure, or any combination of the foregoing. Such a sealing action 2 and a heating action 6 may affix or bond the preformed polycrystalline diamond volume to the substrate. Moreover, solidifying the braze material while the enclosure is exposed to an elevated pressure may develop a selected level of residual stress within the polycrystalline diamond element (i.e., the polycrystalline diamond volume, the braze material, and/or the substrate) upon cooling to ambient temperatures and upon release of the elevated pressure.

Figure 8:
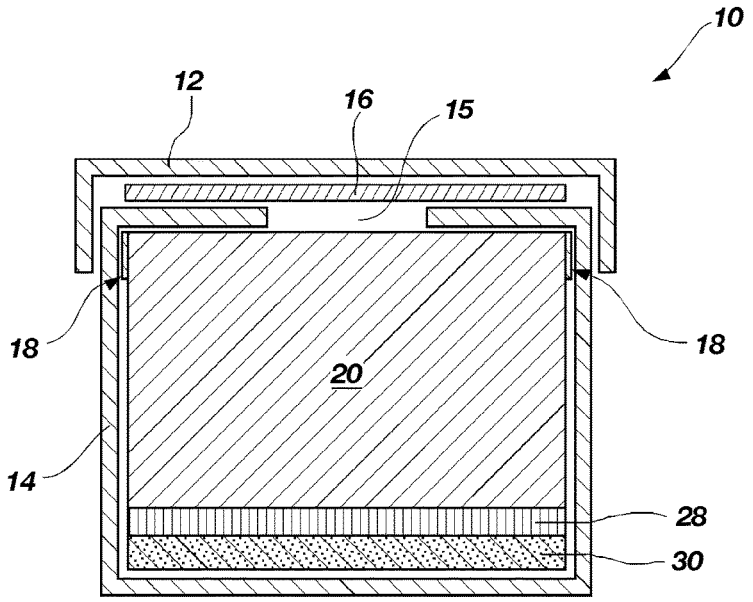
FIG. 8 shows a side cross-sectional view of an enclosure assembly including a preformed superabrasive volume, a substrate, a sealant, an enclosure body, and an enclosure cap.

As described above, the present invention contemplates that a superabrasive volume and at least a portion of a substrate may be enclosed within an enclosure. FIGS. 8-14 show features and attributes of some embodiments of enclosures, preformed superabrasive structures, and substrates that may be employed by the present invention. For example, FIG. 8 shows a schematic, side cross-sectional view of an enclosure assembly 10 including a preformed superabrasive volume 30, a substrate 20, a sealant 16, an enclosure body 14, and an enclosure cap 12. Optionally, as shown in FIG. 8, a braze material 28 may be positioned between the preformed superabrasive volume 30 and the substrate 20. In addition, optionally, a sealant inhibitor 18 (a sealant barrier) may be applied to at least a portion of a surface of substrate 20 to inhibit or prevent sealant 16 (upon melting) from adhering to selected surface regions of substrate 20. Further, the enclosure assembly 10 may be placed in an inert environment and heated so that sealant 16 at least partially melts (or otherwise deforms, hardens, adheres to, or conforms) and seals opening 15 defined by enclosure body 14. Put another way, sealant 16 may be at least partially melted to seal between enclosure cap 12 and enclosure body 14. One of ordinary skill in the art will appreciate that other sealing processes or mechanisms may be employed for sealing an enclosure assembly (e.g., enclosure assembly 10). For instance, an enclosure assembly may be sealed by welding (e.g., laser welding, arc welding, gas metal arc welding, gas tungsten arc welding, resistance welding, electron beam welding, or any other welding process), soldering, swaging, crimping, brazing, or by any suitable sealant (e.g., silicone, rubber, epoxy, etc.). In another embodiment, an enclosure assembly may be sealed by sealing elements (e.g., O-rings), threaded or other mechanical connections, other material joining methods (e.g., adhesives, sealants, etc.) or by any mechanisms or structures suitable for sealing an enclosure assembly, without limitation.

Figure 9:
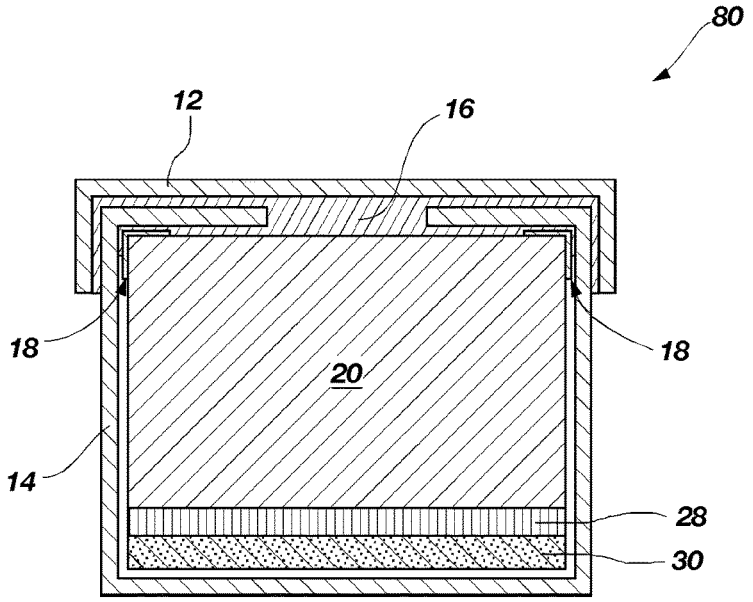
FIG. 9 shows a side cross-sectional view of the enclosure assembly shown in FIG. 8, wherein the sealant seals the enclosure assembly.

Further, enclosure assembly 10 may be exposed to a vacuum (i.e., a pressure less than ambient atmospheric pressure) and sealant 16 may form a sealed enclosure assembly 80, as shown in FIG. 9 in a schematic, side cross-sectional view. Particularly, as shown in FIG. 9, sealant 16 has sealed (or otherwise deformed) between enclosure cap 12 and enclosure body 14 as well as between substrate 20 and enclosure body 14 to seal the preformed superabrasive volume 30, braze material 28, and substrate 20 within an enclosure. Sealed enclosure assembly 80 may inhibit the presence of undesirable contaminants proximate to preformed superabrasive volume 30, substrate 20, or, optionally, braze material 28. More particularly, sealed enclosure assembly 80 may reduce or eliminate the formation of oxides on surfaces of the preformed superabrasive volume 30, the substrate 20, or both. The presence of oxides on surface(s) of one or both of the superabrasive volume and the substrate may interfere with bonding of the superabrasive volume and the substrate to one another. Thus, it may be understood that sealed enclosure assembly 80 may form a relatively robust and/or reliable structure for use in bonding the preformed superabrasive volume 30 to the substrate 20.

Figure 10:
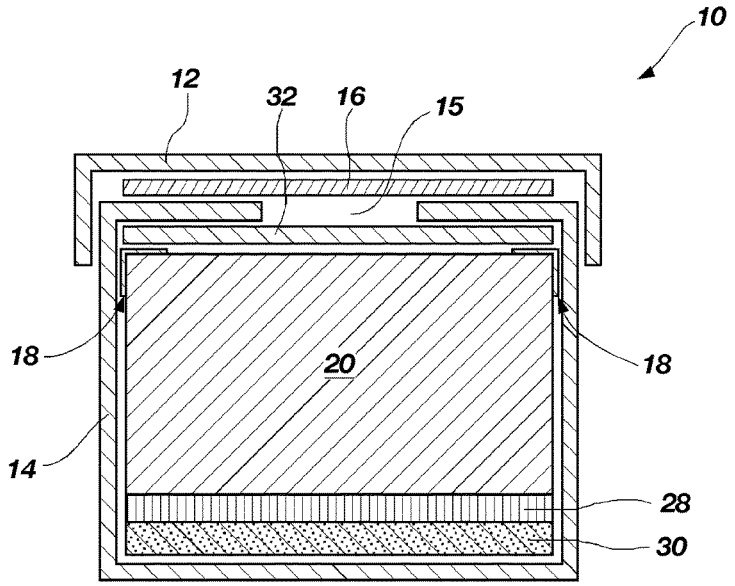
FIG. 10 shows a schematic, side cross-sectional view of another embodiment of an enclosure assembly.

FIG. 10 shows a schematic, side cross-sectional view of a different embodiment of an enclosure assembly 10 including an enclosure cap 12, sealant 16, enclosure body 14, intermediate closure element 32, substrate 20, and preformed superabrasive volume 30. As described above, optionally sealant inhibitor 18, braze material 28, or both, may be included by enclosure assembly 10. Explaining further, enclosure assembly 10 may be exposed to a vacuum by way of a vacuum chamber operably coupled to a vacuum pump or as otherwise known in the art. In addition, sealant 16 may be at least partially melted (i.e., while in an inert environment) so that the gaps between intermediate closure element 32 and enclosure body 14 are sealed. Optionally, gaps between enclosure cap 12 and enclosure body 14 may be sealed. Such a configuration may provide a relatively effective and reliable sealing structure for sealing the preformed superabrasive volume 30 and the substrate 20 within an enclosure and in an inert environment.

Figure 11:
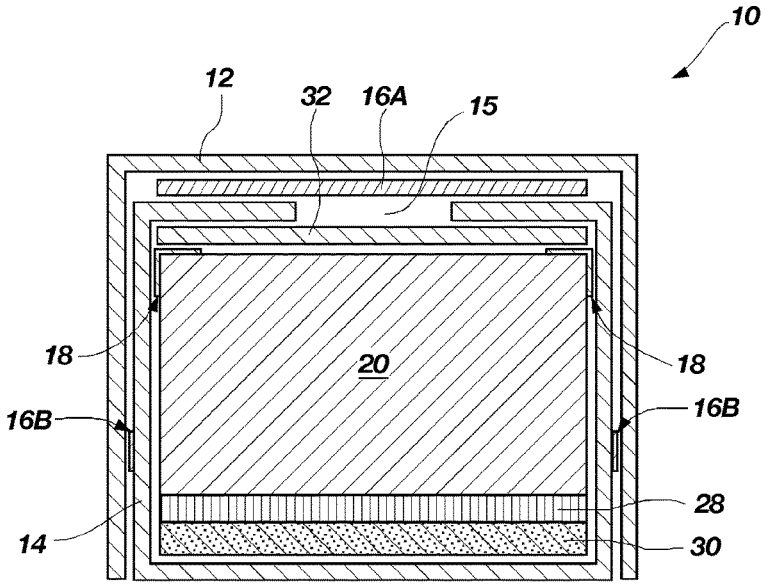
FIG. 11 shows a schematic, side cross-sectional view of an addition embodiment of an enclosure assembly.

Of course, the present invention contemplates many variations relative to the structure and configuration of an enclosure for sealing a preformed superabrasive volume and a substrate in an inert environment. For example, FIG. 11 shows a schematic, side cross-sectional view of a further embodiment of an enclosure assembly 10 including an enclosure cap 12, sealant 16, enclosure body 14, intermediate closure element 32, preformed superabrasive volume 30, and substrate 20. As discussed above, optionally, sealant inhibitor 18, braze material 28, or both, may be included within an enclosure assembly 10. As shown in FIG. 11, sealant 16A may be positioned and configured to seal between intermediate closure element 32 and enclosure body 14, enclosure cap 12, and enclosure body 14, or both. In addition, sealant 16B may be configured to seal between an outer periphery of enclosure body 14 and an inner periphery of enclosure cap 12. Thus, it may be appreciated that a plurality of sealants may be positioned and configured for forming a plurality of seals between an enclosure body, an enclosure cap, and/or optionally an intermediate closure element. A plurality of seal structures forming an enclosure may be desirable to provide a robust, fail safe, or robust and fail safe sealed enclosure for enclosing a preformed superabrasive volume and at least a portion of a substrate.

Figure 12:
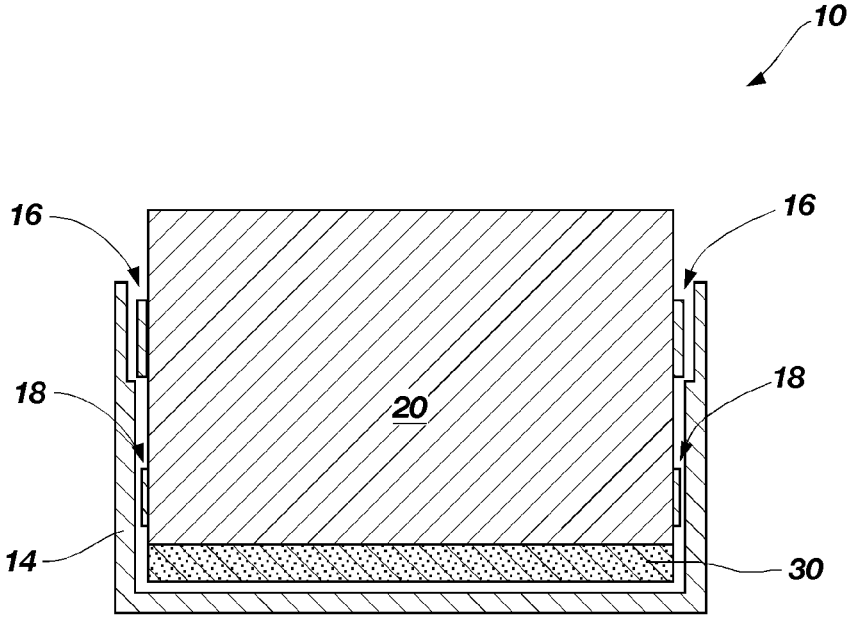
FIG. 12 shows a schematic, side cross-sectional view of a further embodiment of an enclosure assembly.

As mentioned above, the present invention contemplates that a braze material is optional for affixing a preformed superabrasive volume to a substrate. Explaining further, at least one constituent of a substrate, at least one constituent of a preformed superabrasive volume, or a combination of the foregoing may be employed to affix the preformed superabrasive volume to the substrate. For example, FIG. 12 shows a schematic, side cross-sectional view of an enclosure assembly 10 including an enclosure body 14, sealant 16, substrate 20, and preformed superabrasive volume 30. Optionally, as shown in FIG. 12, sealant inhibitor 18 may be positioned to inhibit or prevent sealant 16 from interacting with the preformed superabrasive volume 30. It should be understood that preformed superabrasive volume 30 comprises a sintered structure formed by a previous HPHT process. For example, preformed superabrasive volume 30 may comprise a polycrystalline diamond structure (e.g., a diamond table) or any other sintered superabrasive material, without limitation. In other embodiments, preformed superabrasive volume 30 may comprise boron nitride, silicon carbide, fullerenes, or a material having a hardness exceeding a hardness of tungsten carbide, without limitation. In one example, substrate 20 may comprise a cobalt-cemented tungsten carbide. Accordingly, at elevated temperatures and pressures, such cobalt may at least partially melt and infiltrate or wet the preformed superabrasive volume 30. Upon solidification of the cobalt, substrate 20 and preformed superabrasive volume 30 may be affixed to one another.

Figure 13:
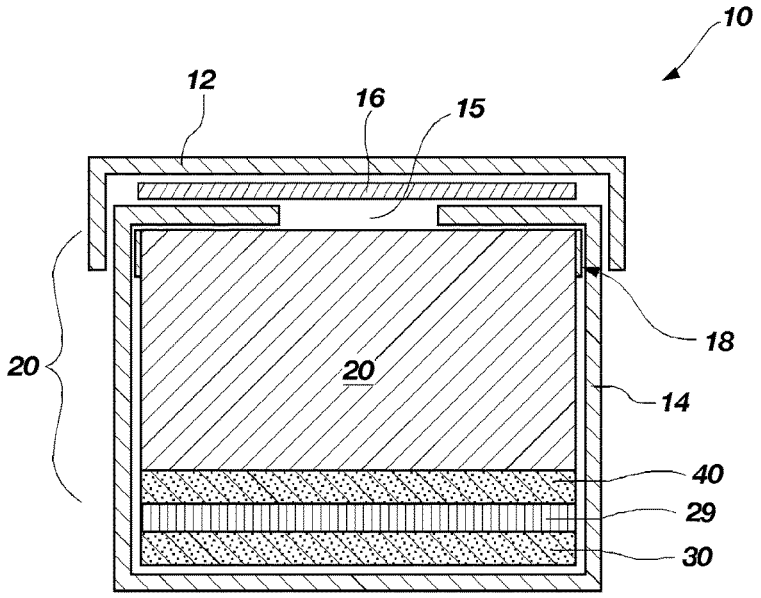
FIG. 13 shows a schematic, side cross-sectional view of an enclosure assembly including a preformed superabrasive volume, a substrate comprising a superabrasive compact, a sealant, an enclosure body, and an enclosure cap.
Figure 14:
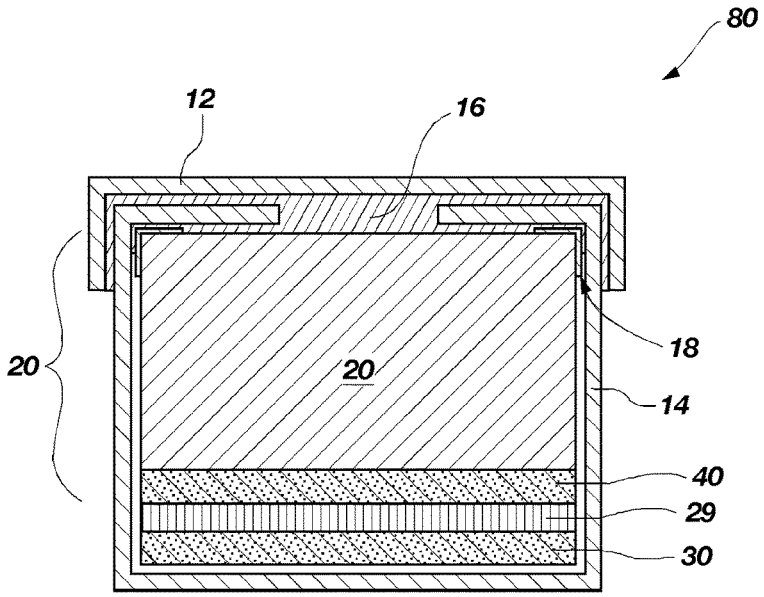
FIG. 14 shows a schematic, side cross-sectional view of the enclosure assembly shown in FIG. 13, wherein the sealant seals the enclosure assembly.

In another embodiment, a substrate may comprise a superabrasive compact (e.g., a polycrystalline diamond compact). For example, FIG. 13 shows a schematic, side cross-sectional view of an enclosure assembly 10 including an enclosure cap 12, a sealant 16, an enclosure body 14, a preformed superabrasive volume 30, and a substrate 20. In one embodiment, the substrate 20 may comprise a base 21 and a superabrasive table 40 (e.g., a polycrystalline diamond table) formed upon the base 21. Put another way, substrate 20 may comprise a superabrasive compact comprising a superabrasive table 40 formed upon the base 21. Optionally, braze material 29 may be positioned between preformed superabrasive volume 30 and superabrasive table 40. As described above and shown in a schematic, side cross-sectional view in FIG. 14, a sealed enclosure assembly 80 may be formed, in an inert environment, by melting sealant 16 to form a sealed enclosure 80.

Figure 15:
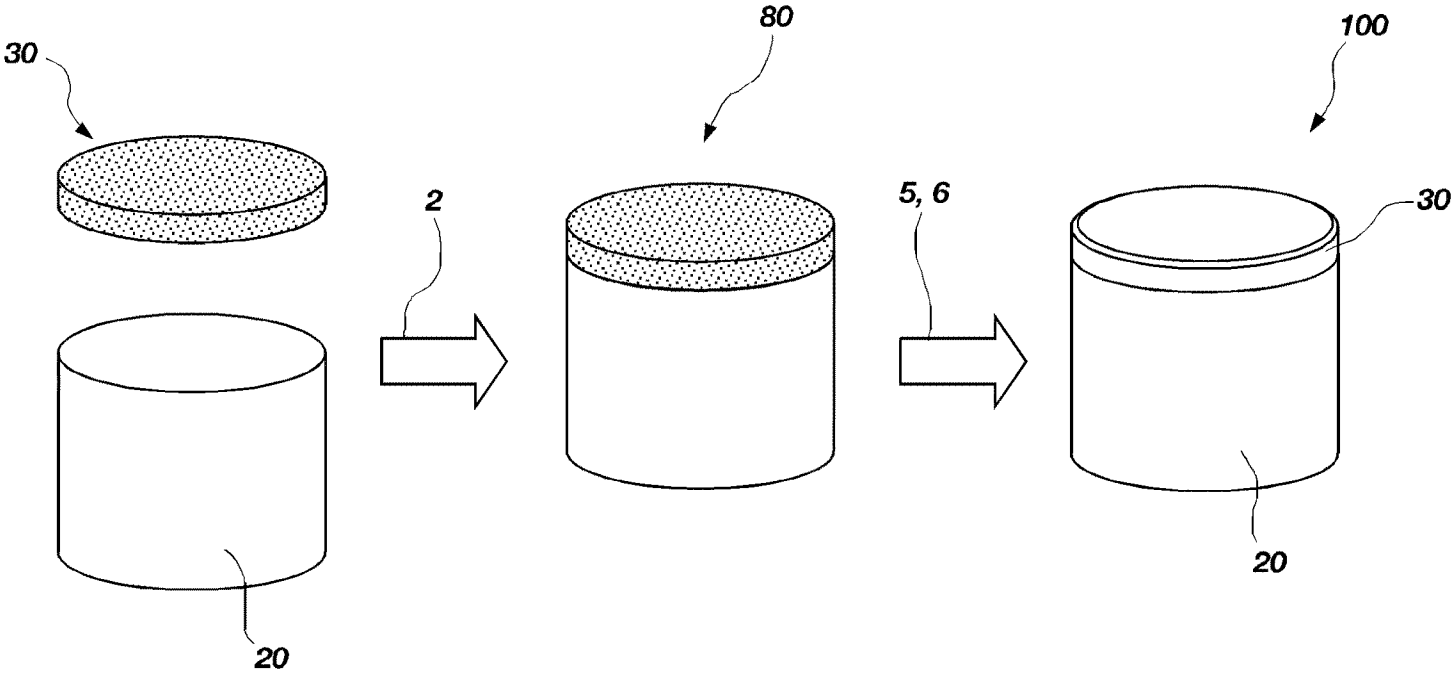
FIG. 15 shows a schematic representation of a method for forming a superabrasive compact.

FIG. 15 shows a schematic representation of a method for forming a superabrasive compact 100. Particularly, as described above, a preformed superabrasive volume 40 may be positioned adjacent to a substrate 20 and may be sealed within an enclosure by way of a sealing action 2 to form a sealed enclosure assembly 80. Further, a sealed enclosure assembly 80 may be subjected to both a pressurizing action 5 and a heating action 6 (e.g., a HPHT process) to affix substrate 20 and preformed superabrasive volume 30. Of course, other structural elements (e.g., metal cans, graphite structures, salt structures, pyrophyllite or other pressure transmitting structures, or other containers or supporting elements or materials) may be employed for subjecting a sealed enclosure assembly 80 to both a pressurizing action 5 and a heating action 6. Thus, substrate 20 and preformed superabrasive volume 30 may be bonded to one another to form superabrasive compact 100, as shown in FIG. 15

Figure 16:
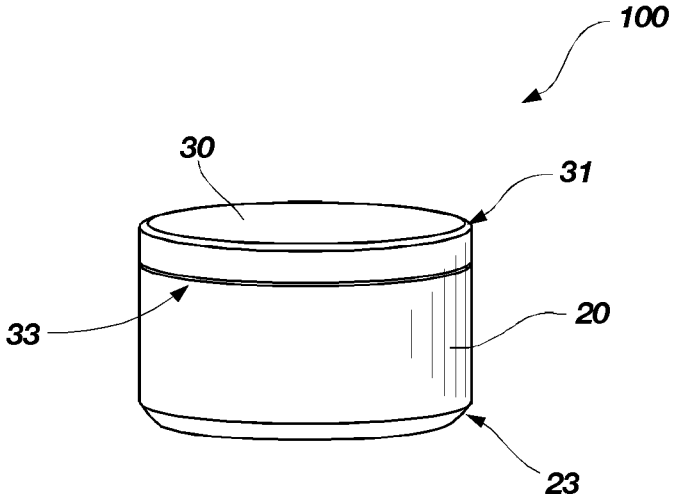
FIG. 16 shows a perspective view of one embodiment of a superabrasive compact.

More particularly, FIG. 16 shows a perspective view of a superabrasive compact 100. As shown in FIG. 16, substrate 20 may be substantially cylindrical and preformed superabrasive volume 30 may also be substantially cylindrical. As shown in FIG. 16, substrate 20 and superabrasive volume 30 may be bonded to one another along an interface 33. Interface 33 is defined between substrate 20 and superabrasive volume 30 and may exhibit a selected non-planar topography, if desired, without limitation. Further, optionally, a braze material may be positioned between substrate 20 and preformed superabrasive volume 30. Further, a selected superabrasive table edge geometry 31 may be formed prior to bonding of the superabrasive volume 30 to the substrate 20 or subsequent to bonding of the superabrasive volume 30 to the substrate 20. For example, edge geometry 31 may comprise a chamfer, buttress, any other edge geometry, or combinations of the foregoing and may be formed by grinding, electro-discharge machining, or by other machining or shaping processes. Also, a substrate edge geometry 23 may be formed upon substrate 20 by any machining process or by any other suitable process. Further, such substrate edge geometry 23 may be formed prior to or subsequent to bonding of the superabrasive volume 30 to the substrate 20, without limitation. Of course, in one embodiment, the present invention contemplates that preformed superabrasive volume 30 may comprise a preformed polycrystalline diamond volume which may be affixed to a substrate 20 comprising a cobalt-cemented tungsten carbide substrate to form a polycrystalline diamond element. For example, such a polycrystalline diamond element may be useful for, for example, cutting processes or bearing surface applications, among other applications.

In another embodiment, a superabrasive compact may include a plurality of superabrasive volumes. Put another way, the present invention contemplates that a preformed superabrasive volume may be bonded to a superabrasive layer or table of a superabrasive compact. Further, one of ordinary skill in the art will appreciate that a plurality of preformed superabrasive volumes may be bonded to one another (and to a superabrasive compact or other substrate) by appropriately positioning (e.g., stacking) each of the plurality of preformed superabrasive volumes generally within an enclosure and exposing the enclosure to an increased temperature, elevated pressure, or both, as described herein, without limitation. Optionally, at least one preformed superabrasive volume and one or more layers of superabrasive particulate (i.e., powder) may be exposed to elevated pressure and temperature sufficient to sinter the superabrasive particulate and bond the at least one preformed superabrasive volume to the superabrasive compact.

Figure 17:
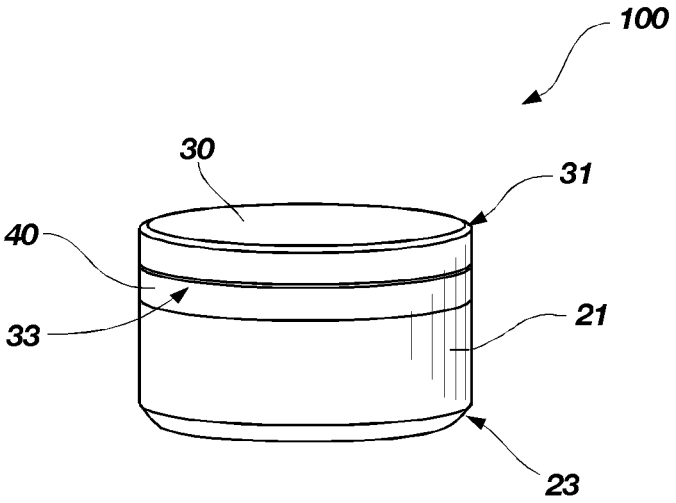
FIG. 17 shows a perspective view of another embodiment of a superabrasive compact.

FIG. 17 shows a perspective view of a superabrasive compact 100 comprising a preformed superabrasive volume 30 bonded to a superabrasive table 40 which is formed upon a base 21. Of course, base 21 and superabrasive table 40 may be described as a superabrasive compact and may comprise, without limitation, a polycrystalline diamond compact. As mentioned above, in one embodiment, superabrasive table 40 may be preformed prior to bonding of preformed superabrasive volume 30 thereto. In another embodiment, superabrasive table 40 may be formed by sintering superabrasive particulate during bonding of preformed superabrasive volume 30 to superabrasive table 40. As shown in FIG. 17, superabrasive table 40 and preformed superabrasive volume 30 may be bonded to one another along an interface 33. Interface 33 may be defined between superabrasive table 40 and superabrasive volume 30 and may exhibit a selected nonplanar topography, if desired, without limitation. Further, optionally, a braze material may comprise interface 33 between superabrasive table 40 and preformed superabrasive volume 30. Further, a selected superabrasive table edge geometry 31 may be formed upon superabrasive volume 30 prior to bonding of the superabrasive volume 30 to the substrate 20 or subsequent to bonding of the superabrasive volume 30 to the substrate 20. For example, a chamfer, buttress, or other edge geometry may comprise edge geometry 31 and may be formed by grinding, electro-discharge machining, or as otherwise known in the art. Similarly, a substrate edge geometry 23 may be formed upon substrate 20, as described above. In one embodiment, the present invention contemplates that preformed superabrasive volume 30 and superabrasive table 40 may each comprise polycrystalline diamond and base 21 may comprise cobalt-cemented tungsten carbide. Such a polycrystalline diamond element may be useful for, among other applications, cutting processes or bearing surface applications.

The present invention contemplates that the method and apparatuses discussed above may be polycrystalline diamond that is initially formed with a catalyst and from which such catalyst is at least partially removed. Explaining further, during sintering, a catalyst material (e.g., cobalt, nickel, etc.) may be employed for facilitating formation of polycrystalline diamond. More particularly, diamond powder placed adjacent to a cobalt-cemented tungsten carbide substrate and subjected to a HPHT sintering process may wick or sweep molten cobalt into the diamond powder. In other embodiments, catalyst may be provided within the diamond powder, as a layer of material between the substrate and diamond powder, or as otherwise known in the art. In either case, such cobalt may remain in the polycrystalline diamond table upon sintering and cooling. As also known in the art, such a catalyst material may be at least partially removed (e.g., by acid-leaching or as otherwise known in the art) from at least a portion of the volume of polycrystalline diamond (e.g., a table) formed upon a substrate or otherwise formed. Catalyst removal may be substantially complete to a selected depth from an exterior surface of the polycrystalline diamond table, if desired, without limitation. Such catalyst removal may provide a polycrystalline diamond material with increased thermal stability, which may also beneficially affect the wear resistance of the polycrystalline diamond material.

More particularly, relative to the above-discussed methods and superabrasive elements, the present invention contemplates that a preformed superabrasive volume may be at least partially depleted of catalyst material. In one embodiment, a preformed superabrasive volume may be at least partially depleted of a catalyst material prior to bonding to a substrate. In another embodiment, a preformed superabrasive volume may be bonded to a substrate by any of the methods (or variants thereof) discussed above and, subsequently, a catalyst material may be at least partially removed from the preformed superabrasive volume. In either case, for example, a preformed polycrystalline diamond volume may initially include cobalt that may be subsequently at least partially removed (optionally, substantially all of the cobalt may be removed) from the preformed polycrystalline diamond volume (e.g., by an acid leaching process or any other process, without limitation).

It should be understood that superabrasive compacts are utilized in many applications. For instance, wire dies, bearings, artificial joints, inserts, cutting elements, and heat sinks may include polycrystalline diamond. Thus, the present invention contemplates that any of the methods encompassed by the above-discussion related to forming superabrasive element may be employed for forming an article of manufacture comprising polycrystalline diamond. As mentioned above, in one example, an article of manufacture may comprise polycrystalline diamond. In one embodiment, the present invention contemplates that a volume of polycrystalline diamond may be affixed to a substrate. Some examples of articles of manufacture comprising polycrystalline diamond are disclosed by, inter alia, U.S. Pat. Nos. 4,811,801, 4,268,276, 4,410,054, 4,468,138, 4,560,014, 4,738,322, 4,913,247, 5,016,718, 5,092,687, 5,120,327, 5,135,061, 5,154,245, 5,364,192, 5,368,398, 5,460,233, 5,480,233, 5,544,713, and 6,793,681. Thus, the present invention contemplates that any process encompassed herein may be employed for forming superabrasive elements/compacts (e.g., "PDC cutters" or polycrystalline diamond wear elements) for such apparatuses or the like.

Figure 18:
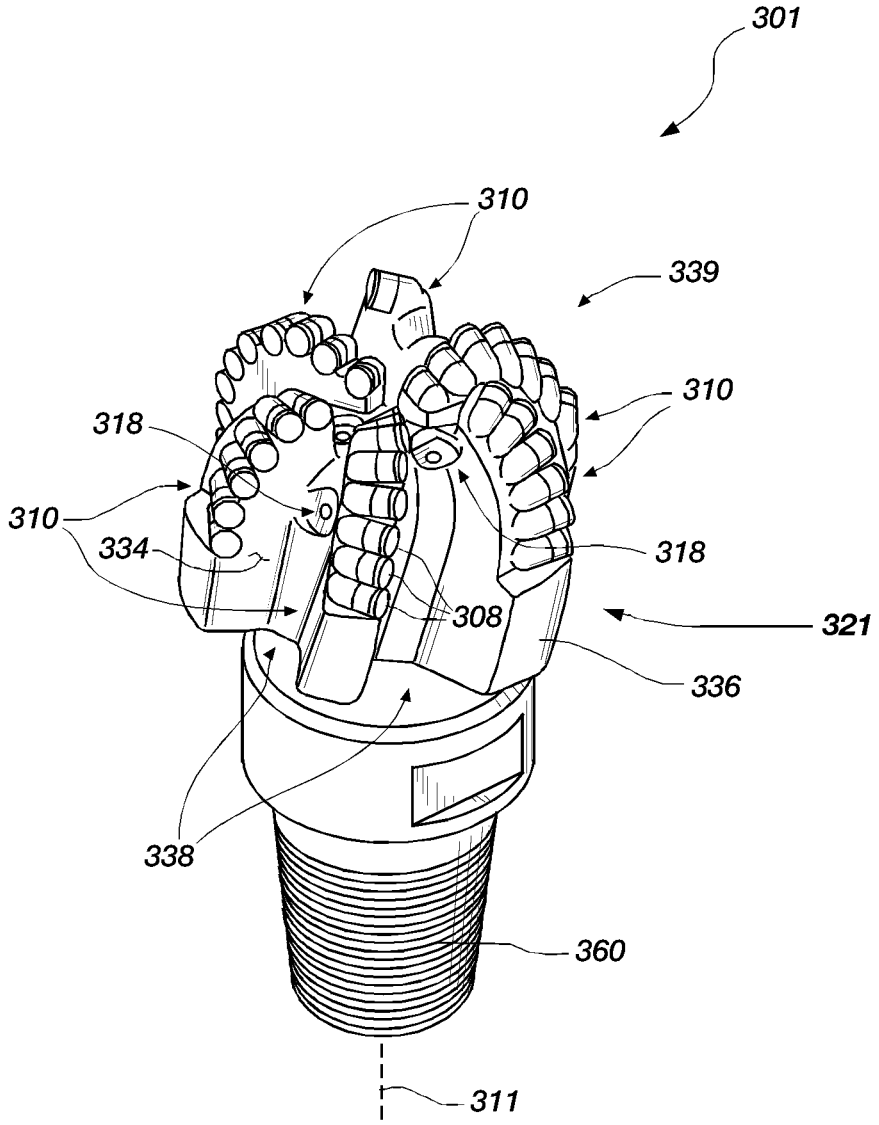
FIG. 18 shows a perspective view of a rotary drill bit including at least one superabrasive cutting element according to the present invention.
Figure 19:
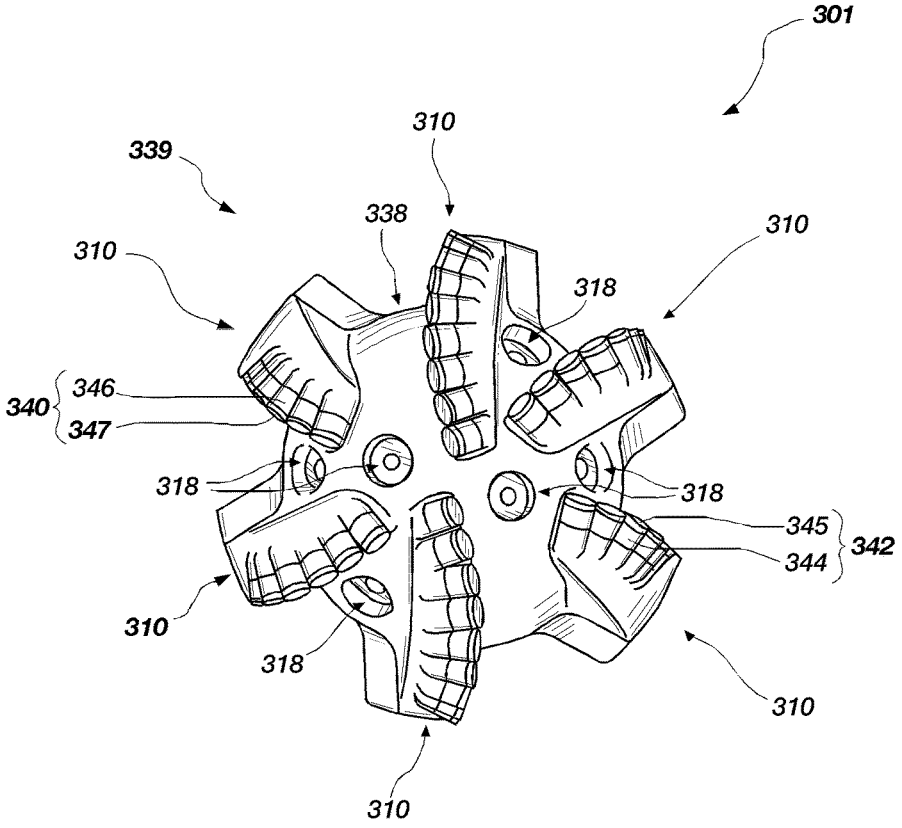
FIG. 19 shows a top elevation view of the rotary drill bit shown in FIG. 18.

As may be appreciated from the foregoing discussion, the present invention further contemplates that at least one superabrasive cutting element as described above may be coupled to a rotary drill bit for subterranean drilling. Such a configuration may provide a cutting element with enhanced wear resistance in comparison to a conventionally formed cutting element. For example, FIGS. 18 and 19 show a perspective view and a top elevation view, respectively, of an example of an exemplary rotary drill bit 301 of the present invention including superabrasive cutting elements 340 and/or 342 secured the bit body 321 of rotary drill bit 301. Superabrasive cutting elements 340 and/or 342 may be manufactured according to the above-described processes of the present invention, may have structural characteristics as described above, or both. Further, as shown in FIG. 19, superabrasive cutting element 340 may comprise at least one preformed superabrasive volume 347 (e.g., comprising polycrystalline diamond, boron nitride, silicon carbide, etc.) bonded to substrate 346. Similarly, superabrasive cutting element 342 may comprise at least one preformed superabrasive volume 345 bonded to substrate 344. Generally, rotary drill bit 301 includes a bit body 321 which defines a leading end structure for drilling into a subterranean formation by rotation about longitudinal axis 311 and application of weight-on-bit. More particularly, rotary drill bit 301 may include radially and longitudinally extending blades 310 including leading faces 334. Further, circumferentially adjacent blades 310 define so-called junk slots 338 therebetween. As shown in FIGS. 18 and 19, rotary drill bit 301 may also include, optionally, superabrasive cutting elements 308 (e.g., generally cylindrical cutting elements such as PDC cutters) which may be conventional, if desired. Additionally, rotary drill bit 301 includes nozzle cavities 318 for communicating drilling fluid from the interior of the rotary drill bit 301 to the superabrasive cutting elements 308, face 339, and threaded pin connection 360 for connecting the rotary drill bit 301 to a drilling string, as known in the art.

It should be understood that although rotary drill bit 301 includes cutting elements 340 and 342 the present invention is not limited by such an example. Rather, a rotary drill bit according to the present invention may include, without limitation, one or more cutting elements according to the present invention. Optionally, each of the superabrasive cutting elements (i.e., 340, 342, and 308) shown in FIGS. 18 and 19 may be formed according to processes contemplated by the present invention. Also, it should be understood that FIGS. 18 and 19 merely depict one example of a rotary drill bit employing at least one cutting element of the present invention, without limitation. More generally, the present invention contemplates that drill bit 301 may represent any number of earth-boring tools or drilling tools, including, for example, core bits, roller-cone bits, fixed-cutter bits, eccentric bits, bicenter bits, reamers, reamer wings, or any other downhole tool including polycrystalline diamond cutting elements or inserts, without limitation.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims. The words "including" and "having," as used herein, including the claims, shall have the same meaning as the word "comprising."

What is claimed is:

1. A polycrystalline diamond compact, comprising:

a cemented carbide substrate including at least one material selected from the group consisting of iron, nickel, and cobalt; and a coherent matrix of bonded diamond grains defining a pre-sintered polycrystalline diamond body with a plurality of interstitial regions between the coherent matrix of bonded diamond grains, the pre-sintered polycrystalline diamond body including:

an upper surface;

a nonplanar interfacial surface;

a side surface extending between the upper surface and the non-planar interfacial surface; and a chamfer extending between the side surface and the upper surface, wherein the chamfer has a length less than a length of the side surface;

wherein the nonplanar interfacial surface of the pre-sintered polycrystalline diamond body is bonded directly to the substrate and the pre-sintered polycrystalline diamond body further comprises:

a first region extending inwardly from the nonplanar interfacial surface and including the at least one material; and a leached second region from which the at least one material has been at least partially removed, the second region extending inwardly from the upper surface.

2. The polycrystalline diamond compact of claim 1 wherein the at least one material has infiltrated the first region.

3. The polycrystalline diamond compact of claim 2 wherein the at least one material has infiltrated the pre-sintered polycrystalline diamond body from the substrate.

4. The polycrystalline diamond compact of claim 1 wherein the pre-sintered polycrystalline diamond body was initially formed with a catalyst that was subsequently leached therefrom.

5. The polycrystalline diamond compact of claim 1 wherein the substrate includes a tungsten carbide.

6. The polycrystalline diamond compact of claim 1 wherein the nonplanar interfacial surface of the pre-sintered polycrystalline diamond body exhibits a selected nonplanar topography.

7. The polycrystalline diamond compact of claim 6 wherein the at least one material is selected from the group consisting of nickel and cobalt.

8. The polycrystalline diamond compact of claim 7 wherein the at least one material comprises cobalt.

9. The polycrystalline diamond compact of claim 7 wherein the pre-sintered polycrystalline diamond body is substantially cylindrical.

10. The polycrystalline diamond compact of claim 7 wherein the substrate is substantially cylindrical.

11. A rotary drill bit, comprising:

a bit body configured to engage a subterranean formation; and a plurality of polycrystalline diamond cutting elements affixed to the bit body, at least one of the polycrystalline diamond cutting elements including:

a cemented carbide substrate including at least one material selected from the group consisting of iron, nickel, and cobalt; and a coherent matrix of bonded diamond grains defining a pre-sintered polycrystalline diamond body with a plurality of interstitial regions between the coherent matrix of bonded diamond grains, the pre-sintered polycrystalline diamond body including: an upper surface;

a nonplanar interfacial surface;

a side surface extending between the upper surface and the non-planar interfacial surface; and a chamfer extending between the side surface and the upper surface wherein the chamfer has a length less than a length of the side surface;

wherein the nonplanar interfacial surface of the pre-sintered polycrystalline diamond body is bonded directly to the substrate and the pre-sintered polycrystalline diamond body further comprises:

a first region extending inwardly from the nonplanar interfacial surface and including the at least one material; and a leached second region from which the at least one material has been at least partially removed, the second region extending inwardly from the upper surface.

12. The drill bit of claim 11 wherein the pre-sintered polycrystalline diamond body was initially formed with a catalyst that was subsequently leached therefrom.

13. The drill bit of claim 11 wherein the cemented carbide substrate includes a cobalt-cemented tungsten carbide substrate.

14. The drill bit of claim 11 wherein the nonplanar interfacial surface of the pre-sintered polycrystalline diamond body exhibits a selected nonplanar topography.

15. The drill bit of claim 11 wherein the at least one material is selected from the group consisting of nickel and cobalt.

16. The drill bit of claim 15 wherein the at least one material is cobalt.

17. The drill bit of claim 16 wherein the cobalt is leached from the leached second region.

18. The polycrystalline diamond compact of claim 1 wherein the pre-sintered polycrystalline diamond body includes a single diamond layer.

* * * * *